US008020800B2

(12) United States Patent
Potts

(10) Patent No.: US 8,020,800 B2
(45) Date of Patent: Sep. 20, 2011

(54) MOBILE RIGS

(75) Inventor: Alan Potts, Fontvielle (MC)

(73) Assignee: MMD Design & Consultancy Ltd., Derbyshire (GB)

( * ) Notice: Subject to any disclaimer, the term of this patent is extended or adjusted under 35 U.S.C. 154(b) by 107 days.

(21) Appl. No.: 12/440,901

(22) PCT Filed: Sep. 12, 2007

(86) PCT No.: PCT/GB2007/003449

§ 371 (c)(1), (2), (4) Date: Mar. 11, 2009

(87) PCT Pub. No.: WO2008/032057

PCT Pub. Date: Mar. 20, 2008

(65) Prior Publication Data

US 2010/0090042 A1 Apr. 15, 2010

(30) Foreign Application Priority Data

| | | |
|---|---|---|
| Sep. 12, 2006 | (GB) | 0617904.8 |
| Feb. 13, 2007 | (GB) | 0702819.4 |
| Feb. 14, 2007 | (GB) | 0702845.9 |
| Feb. 14, 2007 | (GB) | 0702848.3 |
| Feb. 20, 2007 | (GB) | 0703247.7 |
| Mar. 12, 2007 | (GB) | 0704730.1 |
| Apr. 24, 2007 | (GB) | 0707901.5 |

(51) Int. Cl.
*B02C 21/02* (2006.01)

(52) U.S. Cl. ..... 241/101.74

(58) Field of Classification Search ..... 241/101.74–101.742
See application file for complete search history.

(56) References Cited

U.S. PATENT DOCUMENTS 4,763,845 A * 8/1988 Guggenheimer et al. ..... 241/101.71
5,441,206 A * 8/1995 Schade et al. ..... 241/81

FOREIGN PATENT DOCUMENTS

DE 2834987 * 2/1980
WO WO 99/54049 * 10/1999

OTHER PUBLICATIONS

International Preliminary Report on Patentability pertaining to PCT/GB2007/003449, 11 pages.
International Search Report dated Mar. 7, 2005 pertaining to PCT/GB2007/003449, 6 pages.
Written Opinion of the International Search Authority dated Dec. 3, 2009 pertaining to PCT/GB2007/003449, 10 pages.

* cited by examiner

*Primary Examiner* — Mark Rosenbaum
(74) *Attorney, Agent, or Firm* — John D. Lanza; Foley & Lardner LLP

(57) ABSTRACT

A mobile rig for processing mineral material, comprising a feeder including a feed device for receiving mineral and a feeder conveyor arranged to convey mineral. The mobile rig includes a main chassis supporting a mineral breaker; and a discharge conveyor. The mineral breaker has an infeed region via which it receives mineral and a discharge region via which it discharges mineral after processing in the mineral breaker. The feeder conveyor is such as to convey mineral from the feed device to the infeed region of the mineral breaker and the discharge conveyor is such as to convey mineral from the discharge region of the mineral breaker. The rig includes a primary transport carriage on which the main chassis is supported.

25 Claims, 33 Drawing Sheets

MOBILE RIGS

This invention concerns improvements in or relating to mobile rigs and, in particular, to mobile rigs for processing dug mineral in an opencast mine.

In a typical opencast or surface mining operation, mobile shovels dig up mineral and deposit the dug mineral into dumper trucks. The dumper trucks then transport the dug mineral to a mineral processing plant located in the mine.

The mineral processing plant breaks down the dug mineral to ensure that it contains no lumps above a desired size, and so enables the processed mineral to be conveyed out of the mine either in a dry state on a conveyor belt or as a slurry in a pipeline.

Typically the mineral processing plant is a massive structure, which is purpose-built in a specific location, i.e. it is located at a fixed location within the mine.

The use of a static processing plant in an opencast mine requires the use of a fleet of dumper trucks to transport the dug mineral from the shovels to the processing plant. As mining proceeds, the shovels move further away from the static processing plant. More dumper trucks are therefore required to transport the dug mineral to the processing plant if the same rate of feed to the plant is to be maintained. Eventually an economic point may be reached where it becomes more economical to build a new mineral processing plant at a different location in the mine.

Furthermore the use of large dumper trucks is becoming less and less attractive both because of the large amounts of fuel they consume while working; and also because there is presently (2007) a worldwide shortage of tyres for the dumper trucks. Even when available the tyres can cost tens of thousands of dollars.

As a result it is desirable to provide a mobile processing rig that is able to move around the mine as mining proceeds. In order to ensure a maximum throughput of processed mineral it is necessary to maintain a continuous supply of dug mineral to the mobile processing rig such that the time it spends idle is reduced to a minimum According to a first aspect of the invention there is provided a mobile rig, for processing mineral material, comprising a feeder including a feed device for receiving mineral and a feeder conveyor arranged to convey mineral; a main chassis supporting a mineral breaker; and a discharge conveyor, the mineral breaker having an infeed region via which it receives mineral and a discharge region via which it discharges mineral after processing in the mineral breaker, the feeder conveyor being such as to convey mineral from the feed device to the infeed region of the mineral breaker and the discharge conveyor being such as to convey mineral from the discharge region of the mineral breaker, wherein the rig includes a primary transport carriage on which the main chassis is supported.

The provision of a primary transport carriage effectively enables the rig to form a mineral processing plant for processing mineral in an opencast mine which can be moved from location to location within the mine. This allows the mineral processing plant to be continuously located a relatively short working distance from the shovels, and thereby maintain the need for dumper trucks to a minimum or dispose of them altogether in situations where it is appropriate for the shovels to deposit dug mineral directly into the feed device.

The main chassis may be supported on the primary transport carriage so as to be pivotable relative to the primary transport carriage to raise and lower the feeder relative to the ground.

The ability to raise and lower the feeder relative to the ground allows the feeder to be supported on the ground while dug mineral is deposited into the feeder, and selectively spaced from the ground to allow the rig to move to a new digging location.

Preferably in such embodiments, the feed device, feeder conveyor, main chassis, mineral breaker and discharge conveyor are arranged such that their combined centre of gravity lies over the primary transport carriage throughout the range of pivotal displacement of the main chassis relative to the primary transport carriage.

Maintaining the centre of gravity over the transport carriage throughout the range of pivotal displacement of the main chassis relative to the primary transport carriage ensures that the rig remains stable while moving to another digging location. As a result the time taken in moving the mobile rig to a new digging location is reduced, thereby minimizing any downtime during which the rig is unable to process mineral.

The feeder also preferably includes a rigid frame structure projecting downwardly from the chassis such that a lower end of the feeder is lowered to seat on the ground or raised to clear the ground solely by pivoting of the main chassis relative to the primary transport carriage.

The rigid frame is able to support the feed assembly during loading of the feeder with dug mineral and therefore reduces the likelihood of the rig failing through overloading of the feeder.

In other embodiments, the rig may include an auxiliary transport carriage arranged to support the feeder conveyor and/or the feed device.

The provision of an auxiliary transport carriage means that it is not necessary to support the feeder on the ground while mineral is deposited into the feed device. As a consequence it is not necessary to provide for pivotal movement of the main chassis relative to the primary transport carriage.

The provision of an auxiliary transport carriage also means that the feeder conveyor can be made longer than in prior art rigs and plant without the conveyor being over-stressed in use. This means that at any given time during use the feeder may accommodate a large through put of mineral without the need for e.g. an over-sized hopper at the infeed end of the feeder. As a consequence the feed device may be of an essentially conventional hopper design, which has cost advantages. As a result of the aforesaid arrangement, the feeder is able to receive a large amount of dug mineral from shovels working close by and therefore is able to act as a reservoir of dug mineral. This allows time for the shovels to dig more mineral and load it into the feeder without the supply of dug mineral to a downstream processing element becoming interrupted.

Optionally the feeder conveyor and/or the feed device are pivotally supported on the auxiliary transport carriage to negotiate ground undulations without significantly altering the orientation of the feeder conveyor and/or the feed device. Self-evidently such an arrangement is beneficial since the floor of an opencast mine is rarely level or flat.

Such pivotal support may be provided by supporting the feeder conveyor and/or the feed device on the primary transport carriage via a spherical joint mounting.

Preferably the primary transport carriage includes a pair of parallel, driven, ground-engaging tracks and the rig includes one or more control devices for selectively driving the respective said tracks at different speeds so as to effect steering of the primary transport carriage.

In such embodiments, the orientation of the ground-engaging tracks relative to the main chassis may be fixed in a transverse direction. This arrangement allows the rig to move alongside the shovels and/or an overland conveyor in a mine whilst maintaining the feeder adjacent the shovels for deposit of dug mineral directly into the feed device, and/or maintaining the discharge region of the discharge conveyor adjacent the overland conveyor for discharge of mineral onto the conveyor.

In other embodiments where a better turning ability of the rig is required, i.e. spot turning, the main chassis may be rotatably supported on the primary transport carriage to permit rotation of the main chassis relative to the primary transport carriage.

In embodiments where an auxiliary transport carriage is also provided, the feeder conveyor and/or the feed device are preferably rotatably supported on the auxiliary transport carriage. Such a feature permits operation of the rig in a slewing mode as described below. Conveniently therefore the axes of rotation relative to the respective transport carriages are in use generally vertical.

In another preferred embodiment of the invention the auxiliary transport carriage includes a pair of parallel, driven, ground-engaging tracks and the rig includes one or more control devices for selectively driving the respective said tracks at different speeds so as to effect rotation of the main chassis relative to the primary transport carriage. Thus the rig may readily by operated in a slewing mode if desired. By "slewing mode" is meant a mode (which may or may not incorporate processing of mineral) in which slewing of the main chassis relative to the primary transport carriage occurs.

In another preferred embodiment of the invention the rig includes a slewing gear interconnecting the main chassis and the primary transport carriage to effect selective, powered rotation of the main chassis and the primary transport carriage one relative to the other.

The slewing gear may take any of a range of forms and in one embodiment of the invention includes a slewing rig secured to one of the main chassis and the primary transport carriage; at least one slewing motor that is secured to the other of the main chassis and the primary transport carriage and having an output shaft that is drivingly engaged with the slewing ring. If the slewing gear is present it may not be needed to provide controlled powering of the auxiliary transport carriage for slewing purposes (and vice versa). If the slewing gear is present and the auxiliary transport carriage includes powered or driven tracks the rig may include one or more control devices operatively interconnecting the slewing gear and the auxiliary transport carriage so as to effect coordinated rotation of the main chassis relative to the primary transport carriage on the one hand and rotation of the feeder conveyor and/or the feed device relative to the auxiliary transport carriage on the other.

Preferably in such embodiments the primary transport carriage includes a pair of parallel, driven, ground-engaging tracks and the rig includes one or more control devices for selectively driving the respective said tracks at different speeds so as to effect changes in the orientation of the main chassis relative to the primary transport carriage.

According to a second aspect of the invention there is provided a mobile rig, for processing mineral material, comprising a feeder including a feed device for receiving mineral and a feeder conveyor arranged to convey mineral; a main chassis supporting a mineral breaker; and a discharge conveyor, the mineral breaker having an infeed region via which it receives mineral and a discharge region via which it discharges mineral after processing in the mineral breaker, the feeder conveyor being such as to convey mineral from the feed device to the infeed region of the mineral breaker and the discharge conveyor being such as so convey mineral from the discharge region of the mineral breaker, wherein the rig includes first and second transport carriages on which the main chassis is supported.

The provision of first and second transport carriages allows the main chassis to be made longer to support the feeder and the discharge conveyor. This in turn means that the feeder conveyor can be made longer providing the associated advantages outlined above.

Each of the first and second transport carriages may include a single, driven, ground-engaging track, the first and second transport carriages being arranged in a spaced, parallel configuration and oriented relative to the main chassis in a fixed transverse direction. In such embodiments, the or each single, driven, ground-engaging track may be bolted directly to the main chassis.

The use of single, driven, ground-engaging tracks provides a relative high load carrying capacity. However such tracks are expensive and relatively time consuming to build. Consequently, in other embodiments, the first and/or second transport carriage may be replaced by a pair of parallel, driven, ground-engaging tracks.

The use of a pair of parallel, driven, ground-engaging tracks means that each individual track is considerably smaller than the track which would otherwise be required of a single, driven, ground-engaging track carrying the same load. As a consequence the overall cost and time required to build each track is considerably less, thereby rendering the use of a pair of parallel, driven, ground-engaging tracks cheaper than a single, driven, ground-engaging track.

Regardless of whether the first and/or second transport carriage includes a single, driven, ground-engaging track or a pair of parallel, driven, ground-engaging tracks, in such embodiments the rig preferably includes one or more control devices for selectively driving the transport carriages at different speeds so as to effect steering of the rig.

In other embodiments, each of the first and second transport carriages may include a pair of parallel, driven, ground-engaging tracks, the main chassis being mounted on each pair of tracks by means of a slewing gear to effect selective, powered rotation of the main chassis and the transport carriage, one relative to the other.

To improve the stability of the mobile rig, a third transport carriage may be provided, which is spaced from the first transport carriage in a transverse direction across the width of the main chassis.

In such embodiments, each of the first, second and third transport carriages may include a pair of parallel, driven, ground-engaging tracks, the main chassis being mounted on each pair of tracks by means of a slewing gear to effect selective, powered rotation of the main chassis and the transport carriage, one relative to the other.

According to a third aspect of the invention there is provided a mobile rig, for processing mineral material, comprising a feeder including a feed device for receiving mineral and a feeder conveyor arranged to convey mineral; a main chassis supporting a mineral breaker; and a discharge conveyor, the mineral breaker having an infeed region via which it receives mineral and a discharge region via which it discharged mineral after processing in the mineral breaker, the feeder conveyor being such as to convey mineral from the feed device to the infeed region of the mineral breaker and the discharge conveyor being such as to convey mineral from the discharge region of the mineral breaker, wherein the rig includes first and second transport carriages on which the main chassis is supported, the first transport carriage including a single, driven, ground-engaging track and the second transport carriage including one or more driven, ground-engaging tracks, the ground-engaging tracks being arranged in a spaced, parallel configuration and oriented relative to the main chassis in a fixed transverse direction, and the single ground-engaging track of the first transport carriage being pivotally mounted to allow pivotal movement of the ground-engaging track relative to the chassis in a plane parallel to said transverse direction.

The provision of first and second transport carriages allows the main chassis to be made longer to support the feeder and the discharge conveyor. This in turn means that the feeder conveyor can be made longer providing the associated advantages outlined above.

Pivotally mounting the ground-engaging track of the first transport carriage to allow pivotal movement of the ground-engaging track relative to the chassis in a plane parallel to the transverse direction also allows the rig to negotiate ground undulations and uneven ground whilst maximizing contact between the ground and the ground-engaging tracks of the first and second transport carriages. It therefore permits optimal distribution of load to the ground-engaging tracks of the first and second transport carriages to be maintained.

In preferred embodiments, the ground-engaging track of the first transport carriage is pivotally mounted between a pair of opposed frame elements. In such embodiments each frame element includes a pivot shaft bearing to receive a pivot shaft extending from a respective side of the ground-engaging track so as to define co-axial pivot joints on opposite sides of the ground-engaging track.

To resist movement of the ground-engaging track towards either frame element on either side of each pivot joint, a buffer assembly is preferably provided on each side of each pivot joint on each side of the ground-engaging track of the first transport carriage.

This arrangement helps to resist twisting movement of the ground-engaging track between the frame elements. It thereby minimizes the otherwise damaging effects to the mechanical integrity of the pivot joints in circumstances where rotational turning moments are applied to the ground-engaging track of the first transport carriage.

Each buffer assembly may include a buffer element extending from a respective side of the ground-engaging track and a corresponding buffer element extending from a respective frame element such that buffer faces on the buffer elements abut each other.

Cooperating buffer faces are preferably shaped to maintain abutting contact therebetween during the range of pivotal movement of the ground-engaging track of the first transport carriage relative to the carriage.

This may be achieved, for example, by providing elongated buffer faces on the buffer elements extending from the frame elements. In such arrangements, the buffer face on each of the buffer elements extending from the ground-engaging track slides along the length of the buffer face of the corresponding buffer element extending from the respective frame element during pivotal movement of the ground-engaging track relative to the chassis. It is envisaged that such an arrangement could be reversed and that elongated buffer faces could be provided on the buffer elements extending from the ground-engaging track.

One or more control devices is preferably provided to selectively drive the ground-engaging tracks of the respective transport carriages at different speeds and in different directions, as required, so as to control movement of rig and effect steering thereof.

The or each control device may include a gearbox associated with each ground-engaging track. In such embodiments, the gearboxes are preferably fixedly mounted relative to the chassis and a drive shaft extending from the gearbox associated With the ground-engaging track of the first transport carriage is coupled to a drive shaft provided to drive the ground engaging track of the first transport carriage by means of a gear coupling having a floating outer sleeve.

The gear coupling having a floating sleeve maintains driving engagement between the drive shafts, accommodating both angular and radial misalignment between the ends of the shafts during pivotal movement of the ground-engaging track relative to the chassis.

The second transport carriage may include a single, driven, ground-engaging track or a pair of parallel, driven, ground-engaging tracks, the use of a pair of parallel, driven, ground-engaging tracks providing the associated advantages outlined above.

In any of the aspects of the invention outlined above, the feeder conveyor may extend between the feed device and the main chassis at an angle in the range of 14-23° to level ground, and preferably in the range 15-22° to level ground. Most preferably the feeder conveyor extends at an angle of approximately 18° to level ground. An angle of inclination of approximately 18° helps to assure that the problem of hang-up or freezing, discussed herein, that is encountered when mining oil sand does not occur.

The main chassis may optionally include supported thereon a hollow booth having at least one pedestrian entry/exit opening located approximately at the level on the main chassis of the mineral breaker.

The provision of a booth at or adjacent the level of the mineral breaker facilitates maintenance of the rig, especially in cold climates.

A mineral deposit end of the discharge conveyor may be located below a discharge chute of the mineral breaker to receive and convey mineral from the discharge region of the mineral breaker towards a mineral discharge end, the discharge conveyor being pivotable to permit adjustment of the angle of inclination of the discharge conveyor to level ground.

In such an arrangement the discharge end of the feed conveyor is preferably fixedly mounted relative to the mineral breaker such that its position relative to the mineral breaker remains the same irrespective of the orientation of the main chassis relative to the ground. This ensures that dug mineral is consistently transferred from the feed conveyor to the mineral breaker.

In other embodiments, the discharge conveyor may include a transfer section fixed generally parallel to level ground below a discharge chute of the mineral breaker to receive and convey mineral from the discharge region of the mineral breaker towards a discharge section of the discharge conveyor which is pivotable relative to the transfer section of the discharge conveyor to permit adjustment of the angle of inclination of the discharge section of the discharge conveyor to level ground.

The provision of a transfer section fixed generally parallel to level ground below the discharge chute of the mineral breaker enables a better seal to be created between the discharge chute and the discharge conveyor. It also provides greater clearance for the deposit of mineral onto the discharge conveyor when compared with arrangements in which the discharge conveyor extends at an angle to level ground below the discharge chute. This increase in clearance below the discharge chute helps to eliminate the compaction of mineral between the discharge chute and the discharge conveyor. This in turn allows a longer mineral breaker to be used having a comparatively larger discharge chute.

The ability to pivotally adjust the discharge section of the discharge conveyor allows the rig to accommodate variations in ground terrain while ensuring that the discharge section of the discharge conveyor is positioned as desired relative to a downstream element, such as an overland removal conveyor.

In yet further embodiments according to any of the aspects of the invention outlined above, the discharge conveyor may include a transfer section extending from the discharge region of the mineral breaker to convey mineral from the discharge region of the mineral breaker to a transfer region where it transfers mineral to a discharge section of the discharge conveyor, the transfer section of the discharge conveyor being fixed at a predetermined angle relative to level ground and the discharge section of the discharge conveyor being pivotable relative to the transfer section of the discharge conveyor to permit adjustment of the angle of inclination of the discharge section of the discharge conveyor to level ground.

In such embodiments, the discharge section of the discharge conveyor is preferably hingedly mounted on the main chassis to permit rotation of the discharge section relative to the main chassis. This allows the discharge section to slew relative to the main chassis and may include a slewing motor is provided to effect selective, powered rotation of the discharge section of the discharge conveyor relative to the main chassis.

In embodiments according to any of the aspects of the invention outlined above, the feed device of the feeder may include a container including a deposit aperture through which mineral is deposited into the container, a support surface to support the mineral and a discharge aperture located in communication with the support surface and through which the mineral is discharged to a downstream processing element; and at least one transfer member moveable relative to the support surface to urge mineral through the discharge aperture towards the downstream processing element.

The provision of a support surface within the container allows the feed device to hold a larger amount of dug mineral than, for example, a conventional hopper of the same height. As a result the feed device is able to receive a large amount of dug mineral from shovels working close by and therefore is able to act as a reservoir of dug mineral. This allows time for the shovels to dig more mineral and load it into the feeder without the supply of dug mineral to a downstream processing element becoming interrupted.

The inclusion of at least one transfer member helps to ensure that no dug mineral is retained in the container, and thereby ensures that all dug mineral is discharged to the downstream processing element.

In a preferred embodiment the or each transfer member includes a planar transfer plate. Such a feature is readily manufacturable and is capable of urging large quantities of dug mineral through the discharge aperture.

In another preferred embodiment the or each transfer member includes a first support plate lying adjacent and substantially parallel to the support surface of the container, each side of the first support plate defining a leading edge, the first support plate being secured to a first edge of the transfer member such that the first support plate and the transfer plate are perpendicular to one another. The inclusion of a first support plate improves the flexural rigidity of the transfer plate, and each leading edge of the support plate is able to act to break up the dug mineral.

Optionally the or each transfer member includes a second support plate, each side of the second support plate defining a leading edge, the second support plate being secured to a second edge of the transfer member opposite the first edge such that the second support plate and the transfer plate are perpendicular to one another.

Such features further increase the flexural rigidity of the transfer plate, and provide additional leading edges to further assist in breaking up dug mineral.

Preferably the or each transfer member includes at least one support web secured between the transfer plate and the or each support plate, the or each exposed edge of the or each support web defining a leading edge. The inclusion of one or more support webs increases still further the rigidity of the transfer member, and provides at least one additional leading edge to break up dug mineral.

At least one of the leading edges may be chamfered. The provision of a chamfer on a given leading edge defines a blade to cut and even more effectively break up dug mineral.

In another preferred embodiment the or each transfer member rotates within the container. Such an arrangement is a convenient way of ensuring that the or each transfer member is able to move over a large area of support surface and therefore urge a large amount of dug mineral through the discharge aperture.

Preferably the container defines a bowl and the feed device further includes a rotor assembly including a rotor housing having at least one transfer member secured thereto, the rotor assembly rotating within the bowl. Such features are readily manufacturable while providing the desired urging of dug mineral through the discharge aperture.

Optionally the rotor housing includes a toothed ring and the feed device further includes at least one motor, the or each motor being engaged with the toothed ring to rotate the rotor assembly. These features provide a desired control of the rotational speed of the rotor while ensuring sufficient torque is available to permit urging of a large volume of dug mineral through the discharge aperture.

The rotor housing may include one or more distribution members secured to an exposed surface thereof, the or each distribution member directing dug mineral away from the exposed surface of the rotor housing and towards the support surface of the container. The provision of one or more distribution members helps to reduce the build up of dug mineral on the exposed surface of the rotor housing and thereby helps to ensure that all the dug mineral is discharged from the feed device to the downstream processing element.

In a further preferred embodiment the or each transfer member includes a wear member located between the transfer member and a surface of the container relative to which the transfer member, in use, moves, the wear member being removable to facilitate repair or replacement. Such a feature permits the transfer member to remain in service indefinitely with only minimal downtime required to repair or replace a worn or damaged wear member.

Optionally the container includes one or more heating elements to warm the dug mineral deposited therein. Warming the dug mineral can help the dug mineral to move more readily and thereby reduces the power required to urge the dug mineral through the discharge aperture.

Optionally the mineral breaker includes a frame having journalled therein two or more rotatable breaker shafts each supporting at least one breaker ring including a plurality of breaker tips, the dimensions of the frame being such that on rotation of the breaker shafts each breaker tip protrudes above the frame while moving along an arc corresponding to a portion of 360° rotation of the associated breaker shaft.

The mineral breaker may include a gearbox or a journal bearing and a frame defining an upwardly facing reject shelf overlying the gearbox or journal bearing and onto which, during use of the mineral breaker, rejected mineral passes, the reject shelf declining downwardly from a location corresponding generally to the lateral extent of the gearbox or journal bearing relative to the frame. The foregoing features assist to define a reject chute at either end of the mineral breaker that is more efficient than prior art reject chutes.

In other embodiments according to any of the aspects of the invention outlined above, the feed device of the feeder may take the form of a hopper formed by hopper side walls mounted on a support chassis of the feeder conveyor to define a mineral deposit area.

In yet further embodiments according to any of the aspects of the invention outlined above, the feed device of the feeder may take the form of an in-ground feeder hopper formed by walls of, for example, compacted mineral erected to surround the sides and end of a mineral deposit end of the feeder conveyor.

There now follows a description of preferred embodiments of the invention, by way of non-limiting example, with reference to the accompanying drawings in which:

FIG. 31(*b*) shows a plan view from above of the feed device shown in FIG. 31(*b*)

Figure 1:
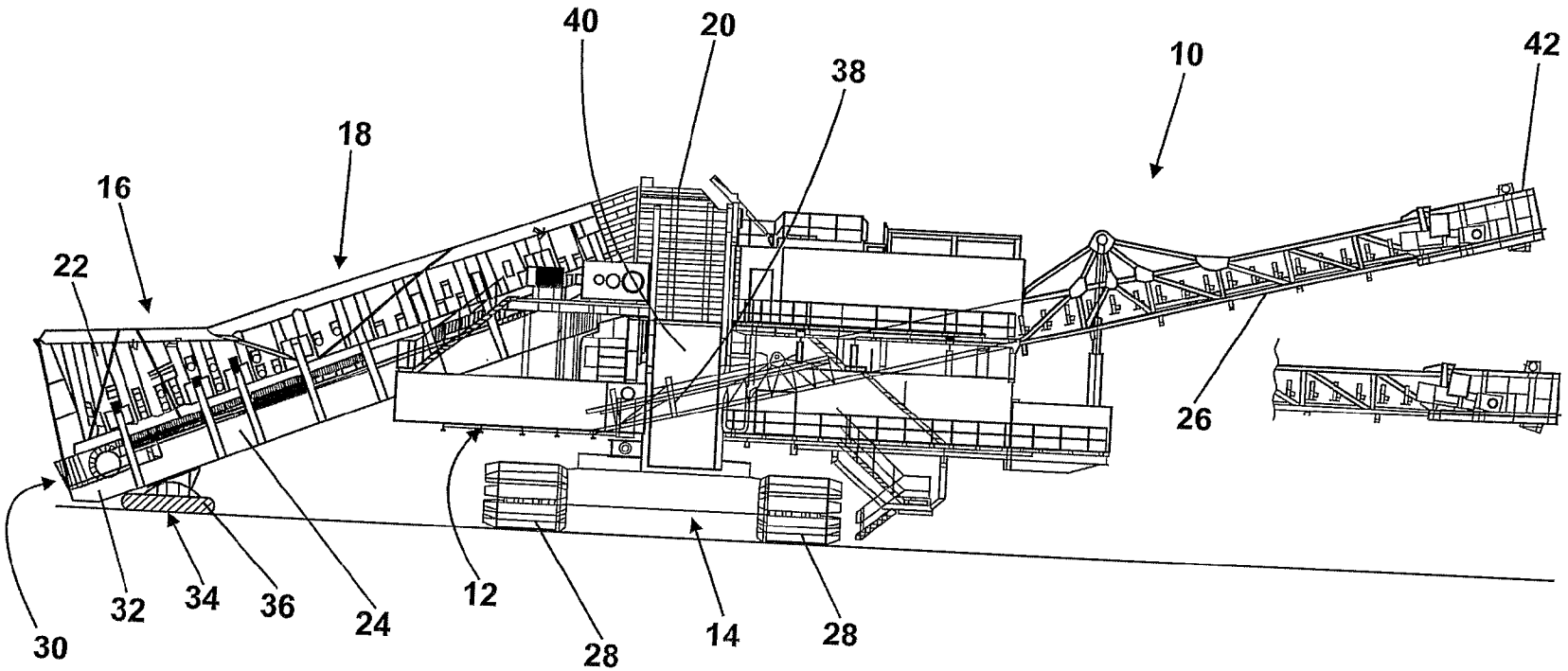
FIG. 1 is an elevational view of a mobile rig according to a first embodiment of the invention showing a main chassis of the mobile rig pivoted at a first angle relative to a primary transport carriage.
Figure 2:
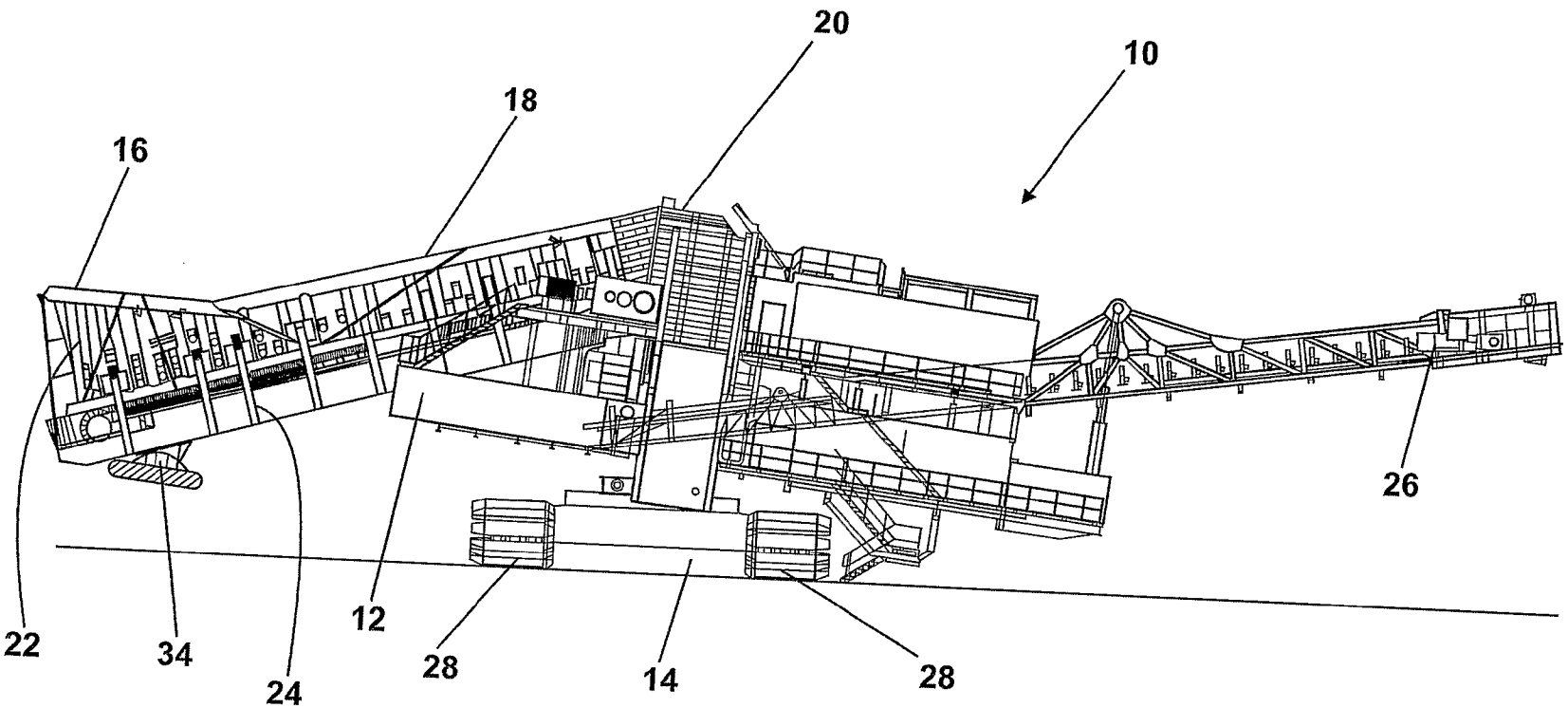
FIG. 2 is an elevational view of the mobile rig shown in FIG. 1 showing the main chassis of the mobile rig pivoted at a second angle relative to the primary transport carriage.

A mobile rig 10 according to a first embodiment of the invention is shown in FIGS. 1 and 2, and includes a main chassis 12 mounted on a primary transport carriage 14.

The mobile rig 10 also includes a feed device in the form of a hopper 16 and a feeder conveyor 18 arranged to convey mineral deposited in the hopper 16 to an infeed region of a mineral breaker 20 mounted on the main chassis 12.

The feeder conveyor 18 is preferably of a plate type having a continuous chain of flights. The hopper 16 is preferably defined by hopper side walls 22 mounted on a support chassis 24 of the feeder conveyor 18 so as to extend along the sides of the support chassis 24 and across the feeder conveyor 18 at a mineral deposit end of the feeder conveyor 18.

The mineral breaker 20 may be of any suitable type, but is preferably a mineral breaker 20 of the type having a plurality of breaker drums such as, for example, one of the mineral breakers disclosed in European patents Nos. 0 167 178, 1 725 335 or 1 809 422.

In the embodiment shown in FIG. 1, the breaker drums of the mineral breaker 20 extend laterally across the width of the main chassis 12. In other embodiments the breaker drum may extend along the length of the main chassis 12, or at another angle relative to the length of the main chassis 12.

A discharge conveyor 26 is also provided and arranged to convey mineral from a discharge region of the mineral breaker 20 to a downstream element, such as an overland removal conveyor (not shown).

The primary transport carriage 14 includes a pair of parallel, driven, ground-engaging tracks 28 and the mobile rig 10 includes one or more control devices (not shown) for selectively driving the respective said tracks 28 at different speeds so as to effect steering of the primary transport carriage 14.

In the embodiment shown in FIG. 1, the ground-engaging tracks 28 are fixed in a transverse orientation relative to the main chassis 12 of the mobile rig 10. In other embodiments, as will be described later, the main chassis 12 may be supported on the primary transport carriage 14 to permit rotation of the main chassis 12 relative to the primary transport carriage 14.

The main chassis 12 is supported on the primary transport carriage 14 so as to be pivotable relative to the primary transport carriage 14 to raise and lower the hopper 16 relative to the ground.

The main chassis 12 is pivotally mounted to the primary transport 14 via a pivot shaft and is moved about the pivot shaft by an associated hydraulic rain assembly.

The feeder in the form of the hopper 16 and the feeder conveyor 18 includes a rigid frame structure 30 projecting downwardly from the main chassis 12 such that a lower end 32 of the frame structure 30 is lowered to seat on the ground (FIG. 1) or raised to clear the ground (FIG. 2) solely by pivoting of the main chassis 12 about the pivotal connection provided by the pivot shaft. The lower end 32 of the frame structure 30 includes a ground engaging foot 34 having a relatively wide pad 36 for seating upon the ground.

The feeder conveyor 18 is fixedly mounted relative to the mineral breaker 20 such that its position relative to the mineral breaker 20 remains the same irrespective of the orientation of the main chassis 12 relative to the ground.

In the embodiment shown in FIG. 1, the feeder conveyor 18 is arranged at an angle of 22° to level ground when the lower end 32 of the feeder is seated on the ground.

A first end 38 of the discharge conveyor 26 is located below a discharge chute 40 of the mineral breaker 20 to receive mineral discharged via the discharge region of the mineral breaker 20.

The discharge conveyor 26 extends at an angle from the first end 38 to a second end 42, and is pivotally connected to the main chassis 12 such that an operator is able to luff the discharge conveyor 26 to accommodate changes in ground terrain while ensuring that the second end 42 of the discharge conveyor 26 remains able to discharge onto a downstream element, such as an overland removal conveyor (not shown). Luffing cylinders may interconnect the discharge conveyor 26 and the main chassis 12 for this purpose.

In use the main chassis 12 is pivoted relative to the primary transport carriage 14 so as to seat the lower end 32 of the feeder onto the ground. The hopper 16 of the feeder is then loaded with dug mineral, which is discharged from the hopper 16 onto the feeder conveyor 18 for conveyance to the infeed region of the mineral breaker 20.

Following introduction into the mineral breaker 20 via the infeed region of the mineral breaker 20, the mineral is processed to ensure that it contains no lumps over a desired size before being discharged via the discharge chute 40 in the discharge region of the mineral breaker 20 onto the first end 38 of the discharge conveyor 26.

The mineral is then conveyed from the first end 38 of the discharge conveyor 26 to the second end 42 of the discharge conveyor 26 for discharge onto a downstream element (not shown).

When it becomes necessary to move the mobile rig 10, an operative first pivots the main chassis 12 relative to the primary transport carriage 14 so as to raise the lower end 32 of the feeder off the ground, as shown in FIG. 2. The ground-engaging tracks 28 may then be operated to move the mobile rig 10 to the next required location. Once the mobile rig 10 is positioned as desired, the operative pivots the main chassis 12 relative to the primary transport carriage 14 to lower the lower end 32 of the feeder and seat it on the ground.

Figure 3:
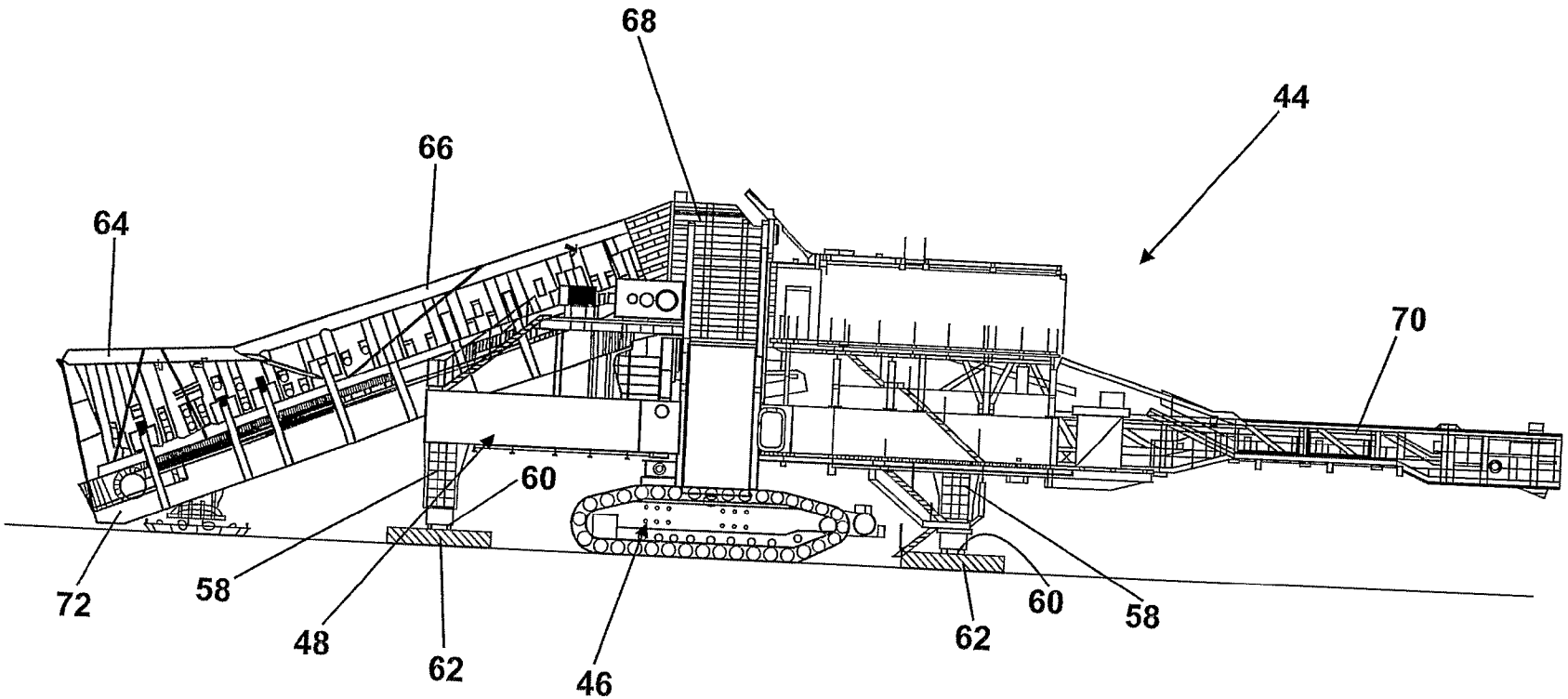
FIG. 3 is an elevational view of a mobile rig according to a second embodiment of the invention showing a main chassis of the mobile rig pivoted at a first angle relative to a primary transport carriage.
Figure 4:
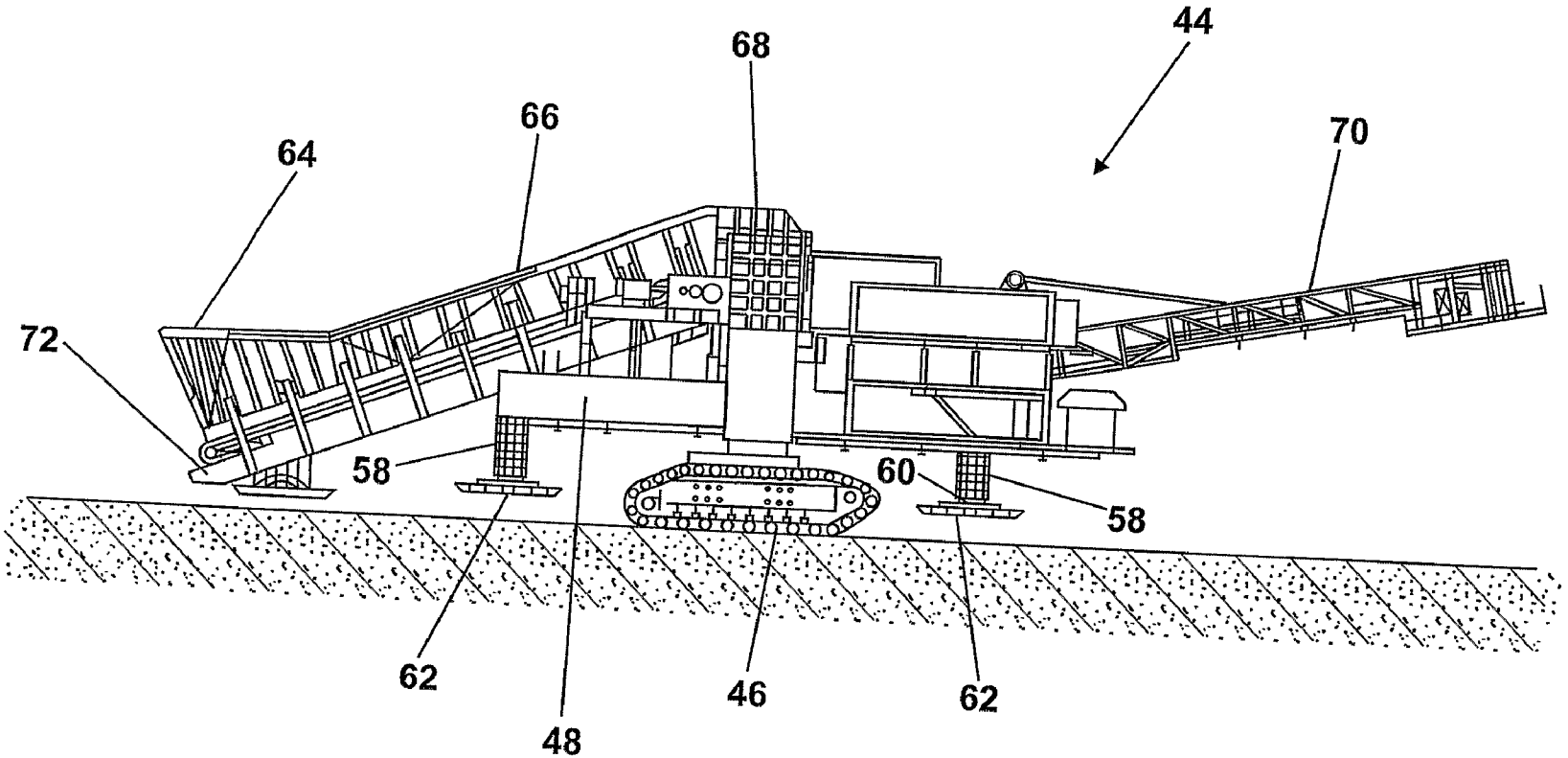
FIG. 4 is an elevational view of the mobile rig shown in FIG. 3 showing the main chassis of the mobile rig pivoted at a second angle relative to the primary transport carriage.

In embodiments where spot turning of the main chassis 12 is required, the main chassis 12 may be rotatably coupled to the primary transport carriage 14, as in the mobile rig 44 shown in FIGS. 3 and 4.

FIGS. 3 and 4 show a mobile rig 44 similar to the mobile rig 10 shown in FIGS. 1 and 2 in which the primary transport carriage 46 includes a slewing assembly (not shown) to secure the primary transport carriage 46 to the main chassis 48 such that the main chassis 48 can slew relative to the primary transport carriage 46 about a generally vertical axis.

The slewing assembly includes a (typically toothed) slewing ring secured e.g. on the underside of the main chassis 48, and one or more rotary slewing motors secured e.g. on the primary transport carriage 46 each having its output shaft drivingly engaged with the slewing ring e.g. by way of a pinion.

Figure 5:
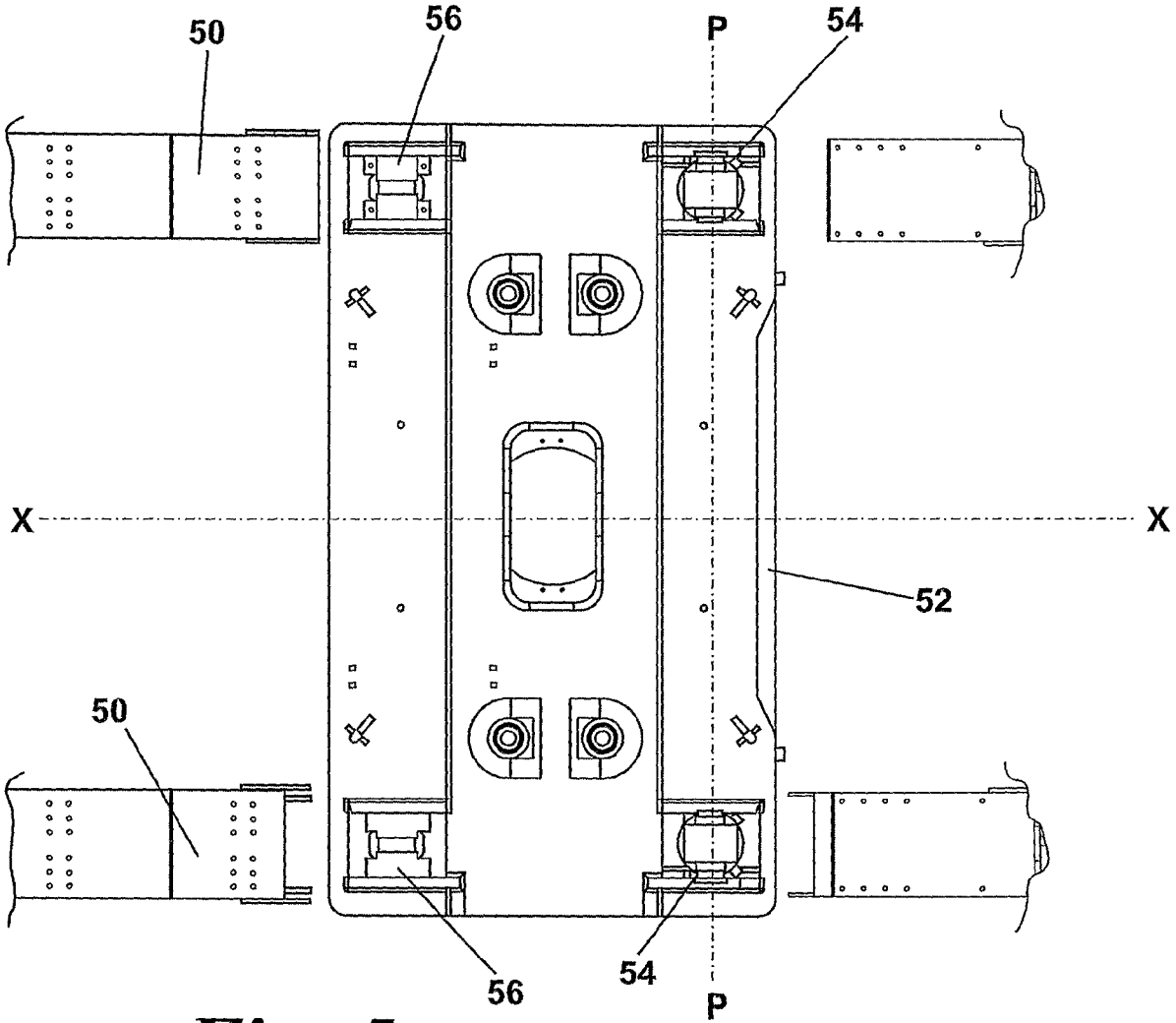
FIG. 5 is a plan view of the mobile rig shown in FIG. 3, partly broken away, showing the main chassis mounted on the primary transport carriage.
Figure 6:
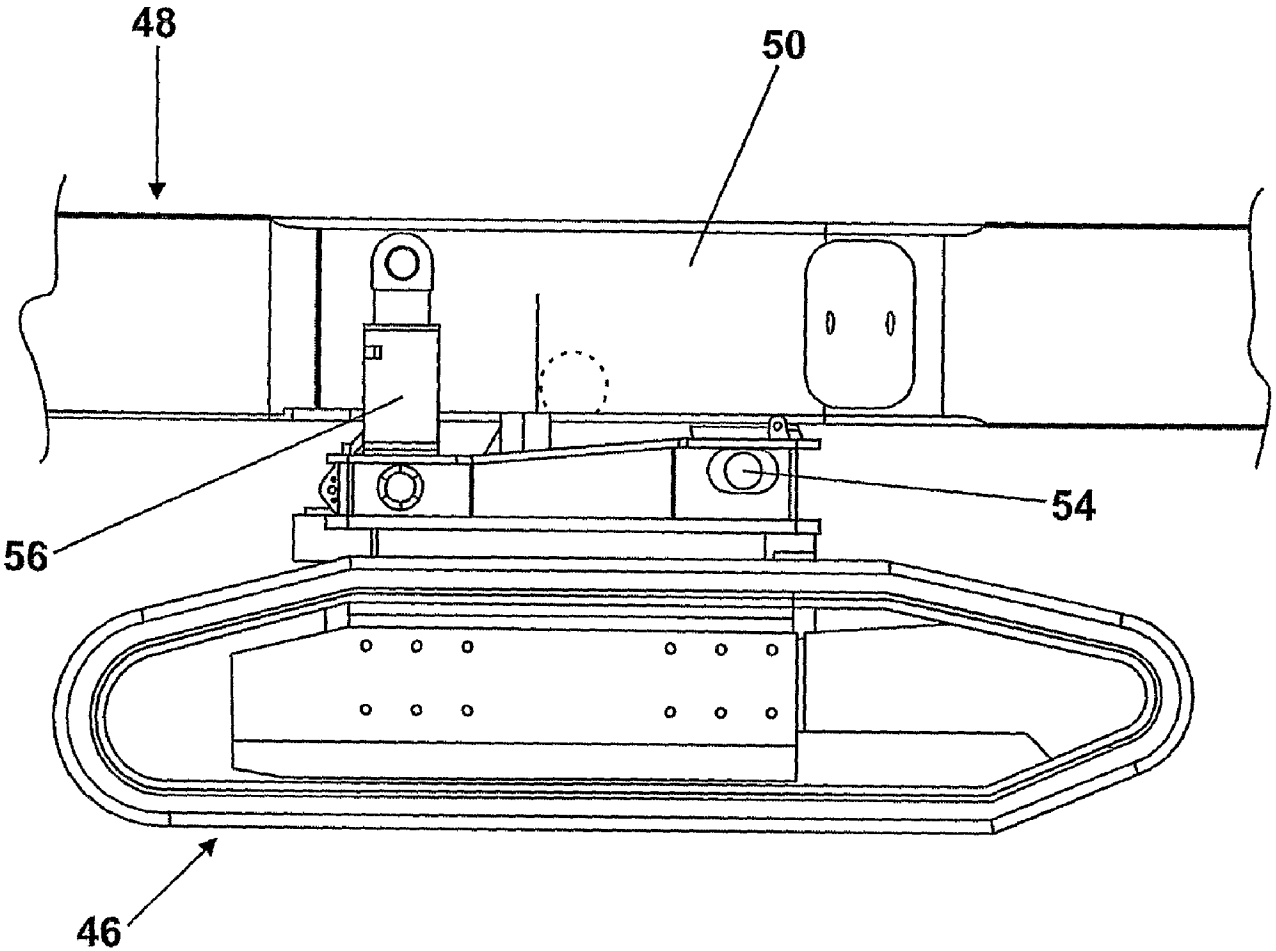
FIG. 6 is a side view of the arrangement shown in FIG. 5.

As shown in FIG. 5, the main chassis 48 preferably includes a pair of longitudinally extending main chassis beams 50, which are secured together by cross beams (not shown). Preferably each main chassis beam 50 is pivotally mounted on a plinth 52 via a respective pivot shaft 54, and is moved about its respective pivot shaft 54 by an associated hydraulic ram assembly 56 (FIGS. 5 and 6).

Figure 7:
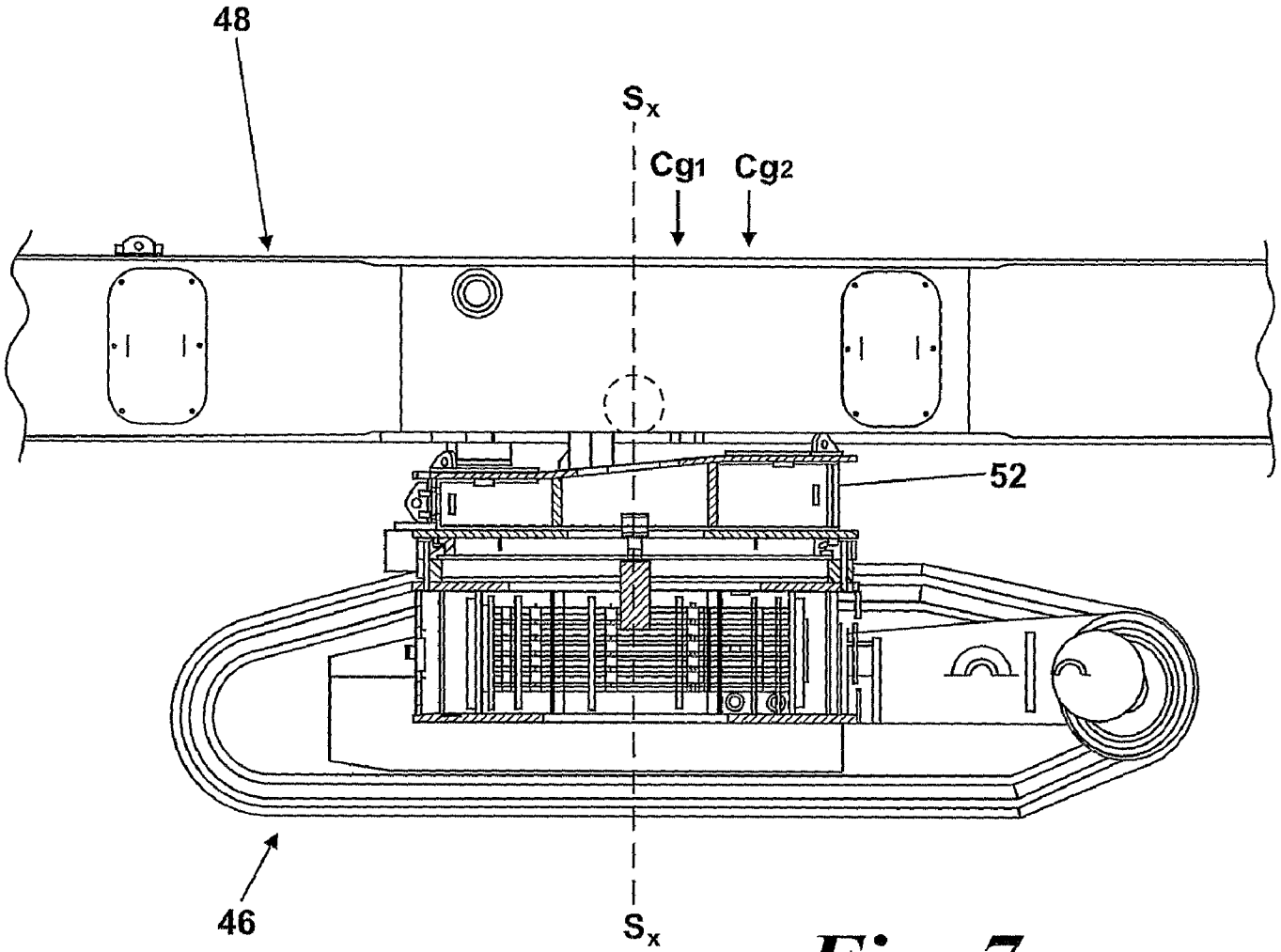
FIG. 7 is a sectional view along the line X-X of the arrangement shown in FIG. 5.

The slewing assembly defines a slewing axis $S_x$, as illustrated diagrammatically in FIG. 7, about which the main chassis 48 is able to slew relative to the transport carriage 46.

As can be seen from FIGS. 3 and 4, the main chassis 48 includes ground engaging support legs 58 located fore and aft of the primary transport carriage 46. A pair of support legs 58 is located on each side of the main chassis 48, only the pair of support legs 58 on the near side being visible in FIGS. 3 and 4. Each support leg 58 is extendible and carries a ground engaging foot 60, which includes a relatively wide pad 62 for seating on the ground.

In use, the support legs 58 may be extended to seat their wide pads 62 on the ground in order to provide added support for the main chassis 48 of the mobile rig 44 whilst mineral is processed. In addition the support legs 58 may be extendible to such an extent that they are able to raise the primary transport carriage 46 clear of the ground.

This is advantageous in situations where the transport carriage 46 has sunk into soft ground in that the support legs 58 can be used to release the transport carriage 46. It is also advantageous in that it enables the primary transport carriage 46 to be slewed whilst raised above the ground. It therefore enables the mobile rig 44 to move in a desired direction without turning the mobile rig 44 using the primary transport carriage steerage.

Similar ground engaging support legs may optionally be included in the mobile rig 10 shown in FIGS. 1 and 2.

When constructing the mobile rig 44, the main chassis 48, hopper 64, feeder conveyor 66, mineral breaker 68 and discharge conveyor 70 are arranged such that their combined centre of gravity $C_G$ lies over the primary transport carriage 46 throughout the range of pivotal displacement of the main chassis 48 relative to the primary transport carriage 46. This is illustrated schematically in FIG. 7 where $C_{g1}$ and $C_{g2}$ illustrate the limits of the range of displacement of the combined centre of gravity $C_g$ when the main chassis 48 is tipped to its limits of pivotal displacement about pivot axis P. (FIG. 5)

The range of angular displacement of the main chassis 48 about the pivot axis P is preferably relatively small. For example, it is preferably chosen to be less than 10° and more preferably it is about 5°. This enables the main chassis 48 to be tipped about pivot axis P and maintain stability of the main chassis 48 and the components it carries whilst the mobile rig 44 is being driven across the ground on the primary transport carriage 46.

During use of the mobile rig 44 to process mineral, the main chassis 48 is tipped about a pivot axis P so that a lower end 72 of the feed conveyor 66 is seated upon the ground. This is illustrated in FIG. 3. The support legs 58 may be extended to engage the ground to give additional support to the main chassis 48.

Before moving the mobile rig 44 to a different location, the ram assemblies 56 are operated to cause the main chassis 48 to tip about the pivot axis P and so raise the lower end 72 of the feed conveyor 66 clear of the ground. This is illustrated in FIG. 4. The transport carriage 46 can then be operated to move the mobile rig 44 across the ground to a different location.

Figure 8:
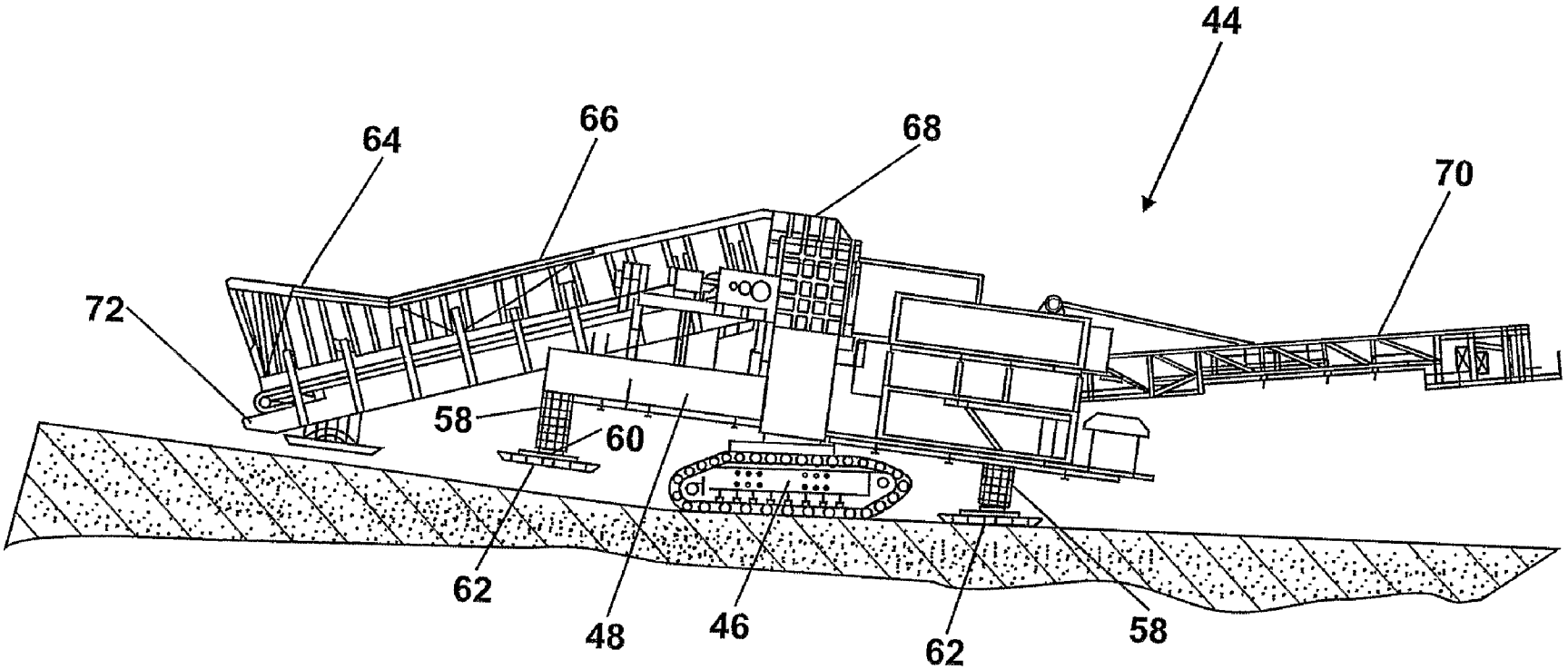
FIG. 8 is an elevational view of the mobile rig shown in FIG. 3 showing the main chassis of the mobile rig pivoted at a third angle relative to the primary transport carriage.

Preferably, the main chassis 48 is tipped to raise the lower end 72 of the feed conveyor 66 only a distance sufficient to clear the ground. However, during transport, the mobile rig 44 may encounter uneven ground or an incline. In such circumstances, the main chassis 48 may be tipped a greater amount to raise the lower end 72 of the feed conveyor 66 further from the ground. This is illustrated in FIG. 8.

Figure 9:
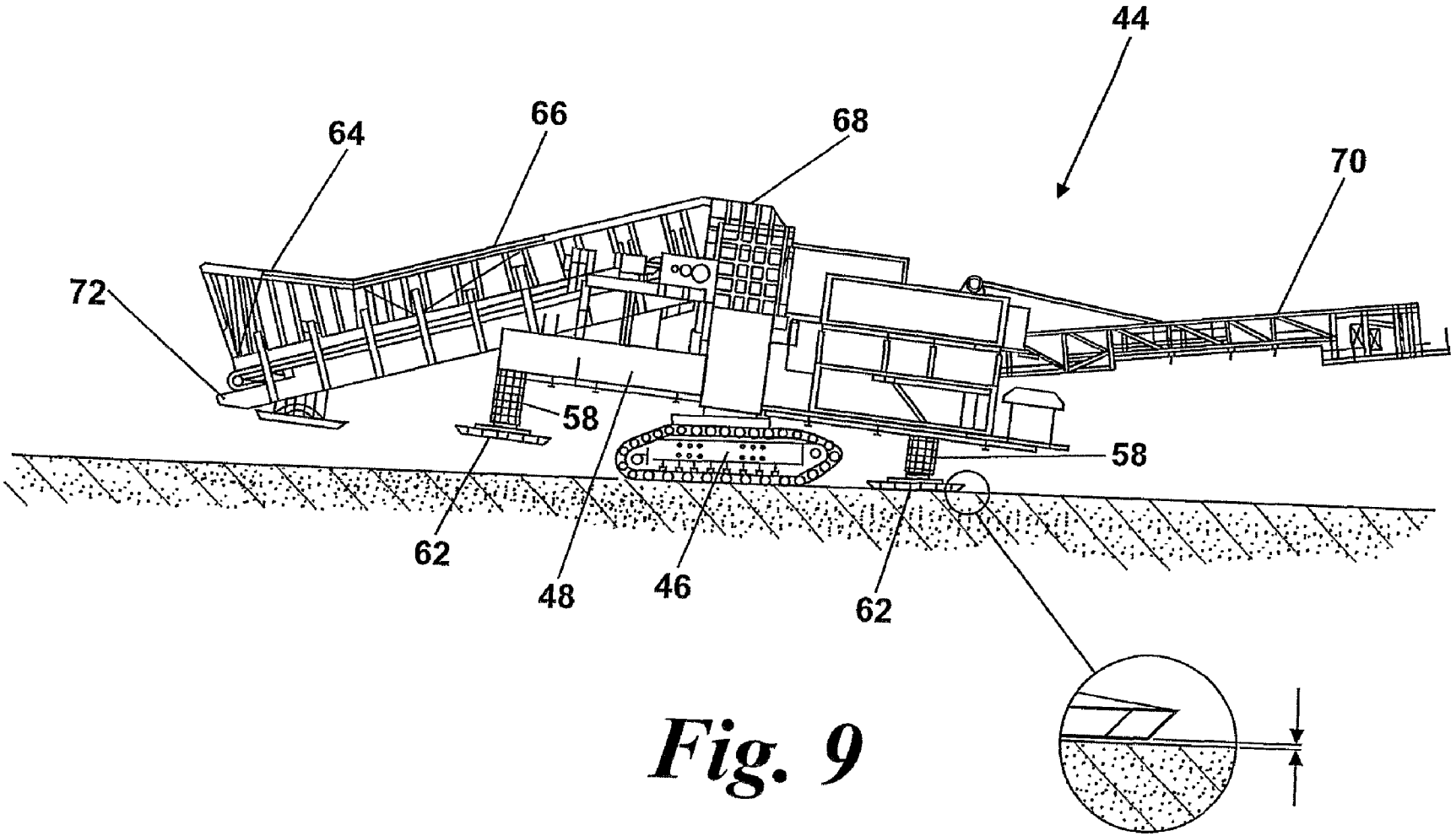
FIG. 9 is an elevational view of the mobile rig shown in FIG. 3 showing the main chassis of the mobile rig pivoted at a fourth angle relative to the primary support carriage.

The maximum amount of tilting permitted is preferably such that, on level ground, the wide pads 62 of the foremost support legs 58 remain clear of the ground by a relatively short distance, which is preferably about 600 mm. This is illustrated in FIG. 9.

Figure 10:
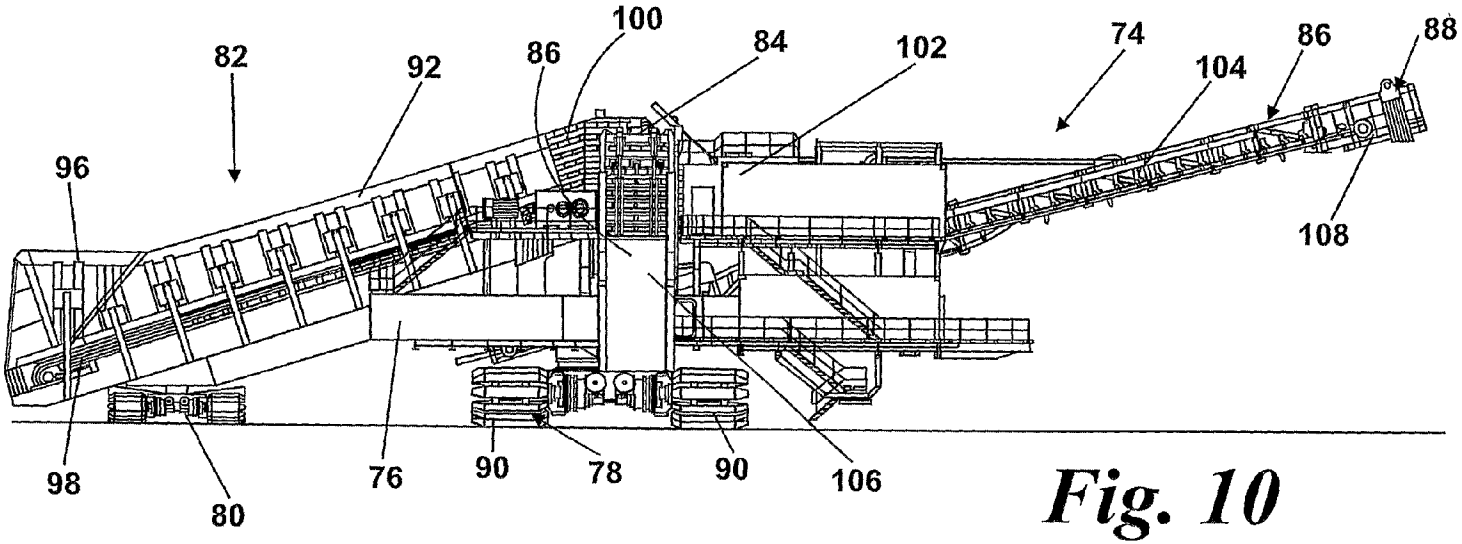
FIG. 10 is an elevational view of a mobile rig according to a third embodiment of the invention showing primary and auxiliary transport carriages of the mobile rig in a first orientation relative to a main chassis.
Figure 11:
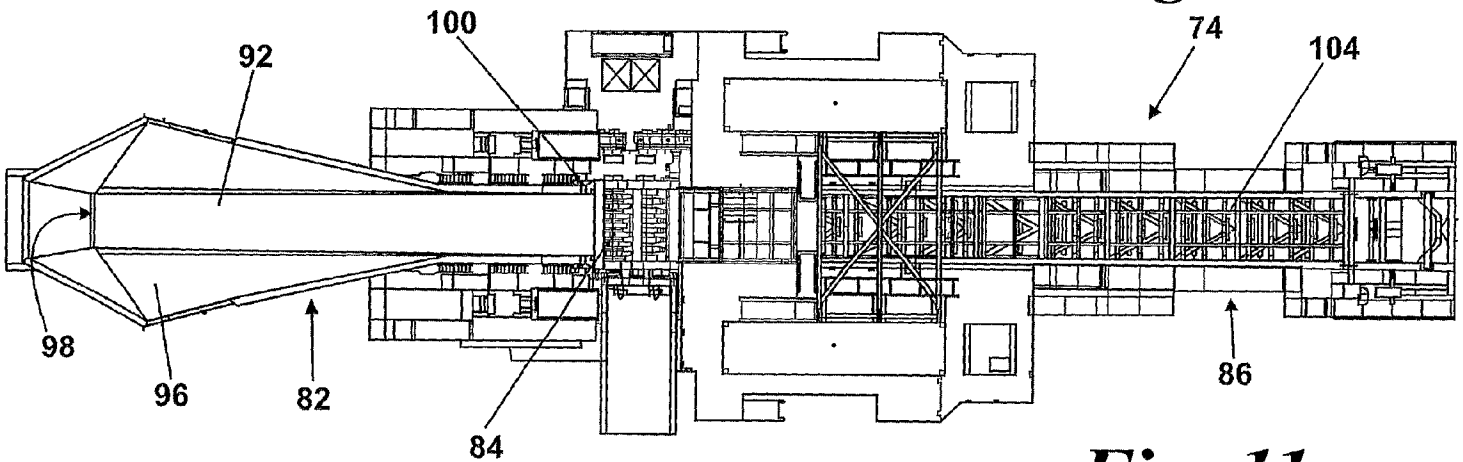
FIG. 11 is a plan view from above of the mobile rig shown in FIG. 10.
Figure 12:
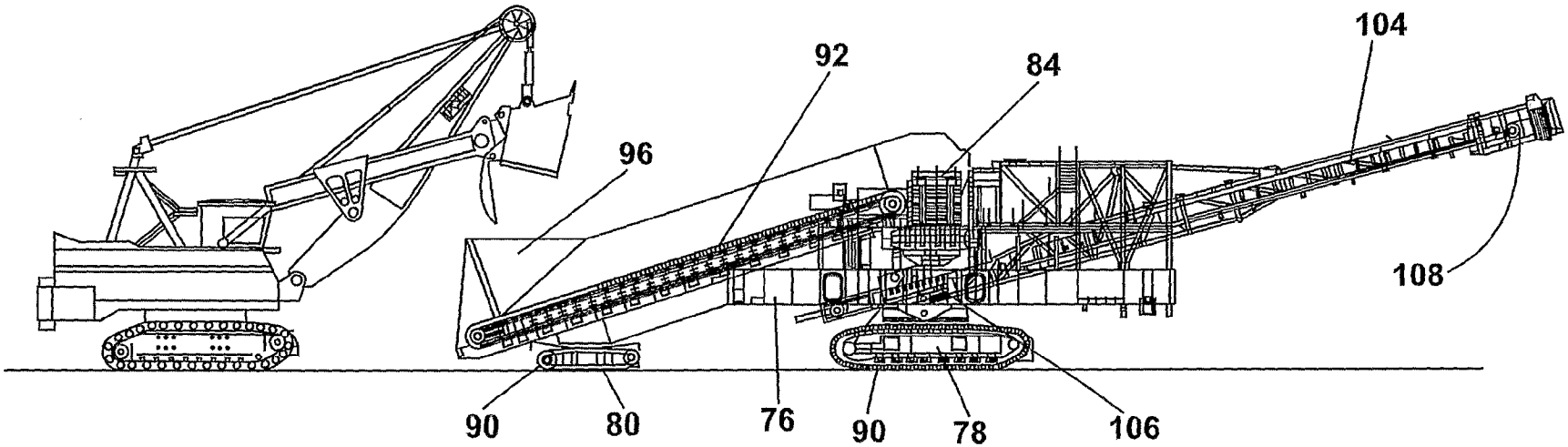
FIG. 12 is an elevational view of the mobile rig shown in FIGS. 10 and 11 showing the primary and auxiliary transport carriages of the mobile rig in a second orientation relative to the main chassis.

A mobile rig 74 according to a third embodiment of the invention is shown in FIGS. 10-12.

The mobile rig 74 comprises a main chassis 76 and primary and auxiliary transport carriages 78, 80, as shown in FIGS. 10-12. The primary transport carriage 78 provides for powered movement of the mobile rig 74 from place to place in a mine.

The main chassis 76 includes a feed assembly 82 to receive dug mineral at a mineral deposit end 98 and convey the dug mineral to a mineral discharge end 100, and a mineral breaker 84 lying in communication with the mineral discharge end 100 of the feed assembly 82 to receive dug mineral discharged therefrom.

The mineral breaker 84 may be of any suitable type, but is preferably a mineral breaker of the type having a plurality of breaker drums such as, for example, one of the mineral breakers disclosed in European patents Nos. 0 167 178, 1 725 335 or 1 809 422. In the embodiments shown, the breaker drums of the mineral breaker 84 extend laterally across the width of the main chassis 76. In other embodiments of mobile rig the breaker drums may extend along the length of the main chassis 76, or at another angle relative to the length of the main chassis 76.

The main chassis 76 also includes a discharge assembly 86 to receive processed mineral from the mineral breaker 84 at a processed mineral deposit end 86 and convey the processed mineral to a processed mineral discharge end 88 from which the processed mineral is discharged to a downstream element, such as an overland conveyor (not shown).

The primary transport carriage 78 is coupled to the main chassis 76 and includes a ground engaging transport assembly and a motive drive assembly to drive the transport assembly across the ground.

The transport assembly includes a pair of ground-engaging tracks 90, each of which is independently powered such that they can be driven separately so as to allow, for example, the transport assembly to spot turn.

The primary transport carriage 78 is rotatably coupled to the main chassis 76 such that the main chassis 76 is rotatable about a generally vertical axis.

The primary transport carriage 78 optionally includes a slewing assembly to secure the primary transport carriage 78 to the main chassis 76 such that the main chassis 76 can slew relative to the foremost transport carriage 78.

As in the second embodiment of the invention described with reference to FIGS. 3 and 4, the slewing assembly includes a (typically, toothed) slewing ring secured e.g. on the underside of main chassis 76, and one or more rotary slewing motors secured e.g. on transport carriage 78 and each having its output shaft drivingly engaged with the slewing ring e.g. by way of a pinion. A control arrangement may be provided to permit controlled operation in a slewing mode (during which, if desired, the rig 74 may continue to move and may continue to process mineral).

The auxiliary transport carriage 80 supports a feed conveyor 92 of the feed assembly 82. As a consequence, in this embodiment, the pivotal connection between the main chassis 76 and the primary transport carriage 78 is omitted since pivotal movement of the main chassis 76 in order to raise and lower the lower end of the rigid frame of the feeder is no longer necessary since the auxiliary transport carriage 80 allows for movement of the feeder assembly 82 over the ground.

The auxiliary transport carriage 80 may include a pair of ground-engaging tracks 90 that are controlledly powered by way of one or more control devices. By controlling the tracks 90 to move at different speeds it is possible to make the auxiliary transport carriage 80 drive one end of the rig 74 in an offset manner so as to effect slewing of the main chassis 76 relative to the primary transport carriage 78. In such a case the aforementioned slewing assembly may not be needed.

However, in embodiments where the slewing assembly is included, a control arrangement may be provided to permit controlled operation in a slewing mode (during which, if desired, the mobile rig 74 may continue to move, and continue to process material).

The auxiliary transport carriage 80 may be pivotally secured to the underside of the feeder conveyor 92 so as to accommodate undulations in the ground without significantly altering the orientation of the feeder conveyor 92. In the embodiment shown in FIG. 10, this pivotal support is provided via a spherical mounting but may also be achieved through use of a mushroom coupling or an equivalent arrangement. The inclusion of such a coupling allows the auxiliary transport carriage 80 to pivot backwards and forwards and side to side relative to the feeder conveyor 92. In this way the auxiliary transport carriage 80 is able to follow the primary transport carriage 78 and accommodate any changes in ground terrain as they may arise.

The spherical joint coupling also permits rotation of the auxiliary transport carriage 80 relative to the feeder conveyor 92 about a generally vertical axis.

The feeder conveyor 92 is shown extending between a hopper 96 and the main chassis 76 and is upwardly inclined relative to the ground at about 18° so as to minimize hang-up.

The feeder conveyor 92 is located in communication with a discharge aperture 98 of the hopper 96.

The feeder conveyor 92 is typically a so-called "plate feeder" which includes a discharge end that defines the mineral discharge end 100 of the feed assembly 82.

In use the feeder conveyor 92 receives dug mineral discharged from the hopper 96 and conveys the dug material to the mineral discharge end 100 of the feed assembly 82.

The discharge end 100 of the feeder conveyor 92 is fixedly mounted relative to the mineral breaker 84 such that its position relative to the mineral breaker 84 remains the same irrespective of the orientation of the main chassis 76 relative to the ground.

The main chassis 76 supports a maintenance booth 102 adjacent to the breaker 84 and at generally the same level as it. This permits convenient maintenance operations.

The discharge assembly 86 of the mobile rig 74 includes a discharge conveyor 104 having a first end 106 defining the processed mineral deposit end of the discharge assembly 86 and a second end 108 defining the processed mineral discharge end of the discharge assembly 86.

In the embodiment shown, the discharge conveyor 104 is pivotally connected to the main chassis 76 such that it is pivotally adjustable through a predetermined range of angles relative to the main chassis 76 in order to provide luffing as described above. Luffing cylinders may interconnect the discharge conveyor 104 and the main chassis 76 for this purpose.

FIGS. 10 and 11 show the transport carriages 78, 80 in a first orientation relative to the remainder of the rig 74 and FIG. 12 in a second orientation, at 90° thereto, following (or during) slewing or spot turning.

In use, shovels load dug mineral into the hopper 96 of the feed assembly 82 at one end of the mobile rig 74. Loading of the hopper 96 can take place while the mobile rig 74 is stationary or while the mobile rig 74 is moving in the mine.

The feeder conveyor 92 conveys the dug mineral from a mineral deposit end 98 to a discharge end 100 thereof from which it is discharged into the mineral breaker 84. The mineral breaker 84 processes the dug mineral to ensure that is contains no lumps over a desired size, and discharges processed mineral onto a first end 106 of a discharge conveyor 104. Any over-sized minerals not processed in this way may be automatically rejected depending on the mineral breaker 84 used.

The discharge conveyor 104 conveys the processed mineral to the second end 108 thereof from which the processed mineral is discharged e.g. onto an overland conveyor.

An operator is able to luff the discharge conveyor 104 to accommodate changes in ground terrain while ensuring the second end 108 of the discharge conveyor 104 remains able to discharge onto the overland conveyor.

A significant factor in the conveying of particular minerals relates to the angle at which the dug mineral is conveyed.

Certain dug minerals can "freeze" or "hang up" if the angles of conveyance are not correctly optimised. Hang-up of the mineral material in the mobile rig 74 is strongly undesirable because of the adverse effect on productivity. In this regard the importance of essentially continuous production in a surface mine cannot be over-emphasised.

As explained hereinabove the feeder conveyor 92 is set at an angle of 18° relative to the ground, this being an optimised angle of conveyance that prevents material hang-up when considering a particular type of mineral.

Other minimum conveyance angles may be suitable for different minerals although typically they will be around the value of 18°. An important design consideration is that the angle of the feeder conveyor 92 is such that the body of material conveyed may be generally as deep in an up-and-down direction as the width of the conveyor 92, without hang-up occurring. This leads to a highly efficient conveying operation that is able to clear mineral out of the hopper 96 as fast as the shovels feed it in, thereby promoting and facilitating continuous production even when there is a requirement for a large hopper.

Figure 13:
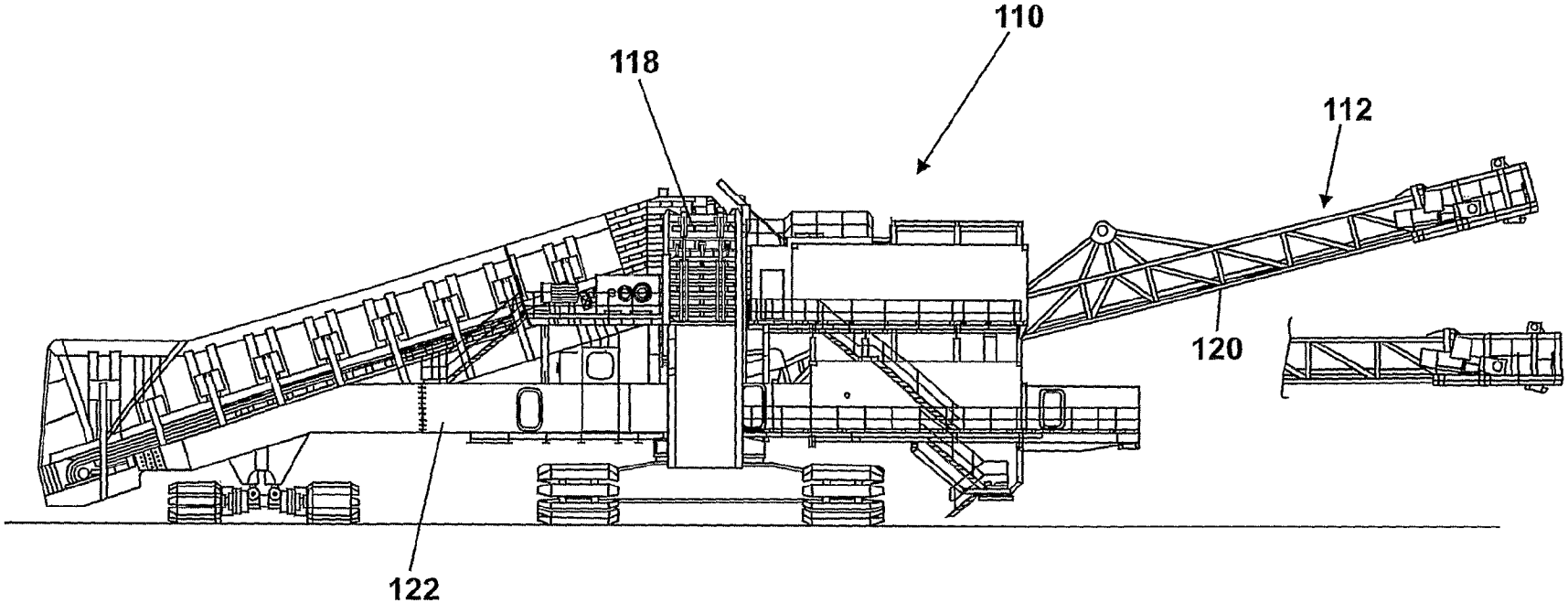
FIG. 13 is an elevational view of a mobile rig according to a fourth embodiment of the invention.

A mobile rig 110 according to a fourth embodiment of the invention is shown in FIG. 13.

The mobile rig 110 shown in FIG. 13 is essentially the same as the mobile rig shown in FIGS. 10-12.

However the discharge conveyor 112 of the mobile rig 110 shown in FIG. 13 differs from the discharge conveyor 104 of the mobile rig 74 shown in FIGS. 10-12 in that it includes a first, transfer section (not shown) fixed generally parallel to level ground below the discharge chute (not shown) of the mineral breaker 118 to receive and convey mineral from the discharge region of the mineral breaker 118 towards a second, discharge section 120 of the discharge conveyor 112. In other embodiments of the invention the first section may be fixed at an angle of up to 15° to level ground.

The second section 120 is pivotally connected to the main chassis 122 to allow luffing of the second section 120 and thereby permit adjustment of the angle of the second section 120 relative to the ground.

Fixing the first section at a predetermined angle to the ground, below the discharge chute of the mineral breaker 118, enables a better seal to be created between the discharge chute and the discharge conveyor 112.

It also provides greater clearance for the deposit of mineral onto the discharge conveyor 112 when compared with arrangements in which the discharge conveyor 112 extends at an angle to level ground below the discharge chute, such as those shown in FIGS. 1-12. This increase in clearance below the discharge chute helps to eliminate the compaction of mineral between the discharge chute and the discharge conveyor 112. This in turn allows a longer mineral breaker to be used having a comparatively large discharge chute.

In use the mobile rig 110 shown in FIG. 13 is loaded with dug mineral, processes the dug mineral and discharges the processed mineral in the same way as described in connection with the mobile rigs described with reference to FIGS. 1-12.

Figure 14:
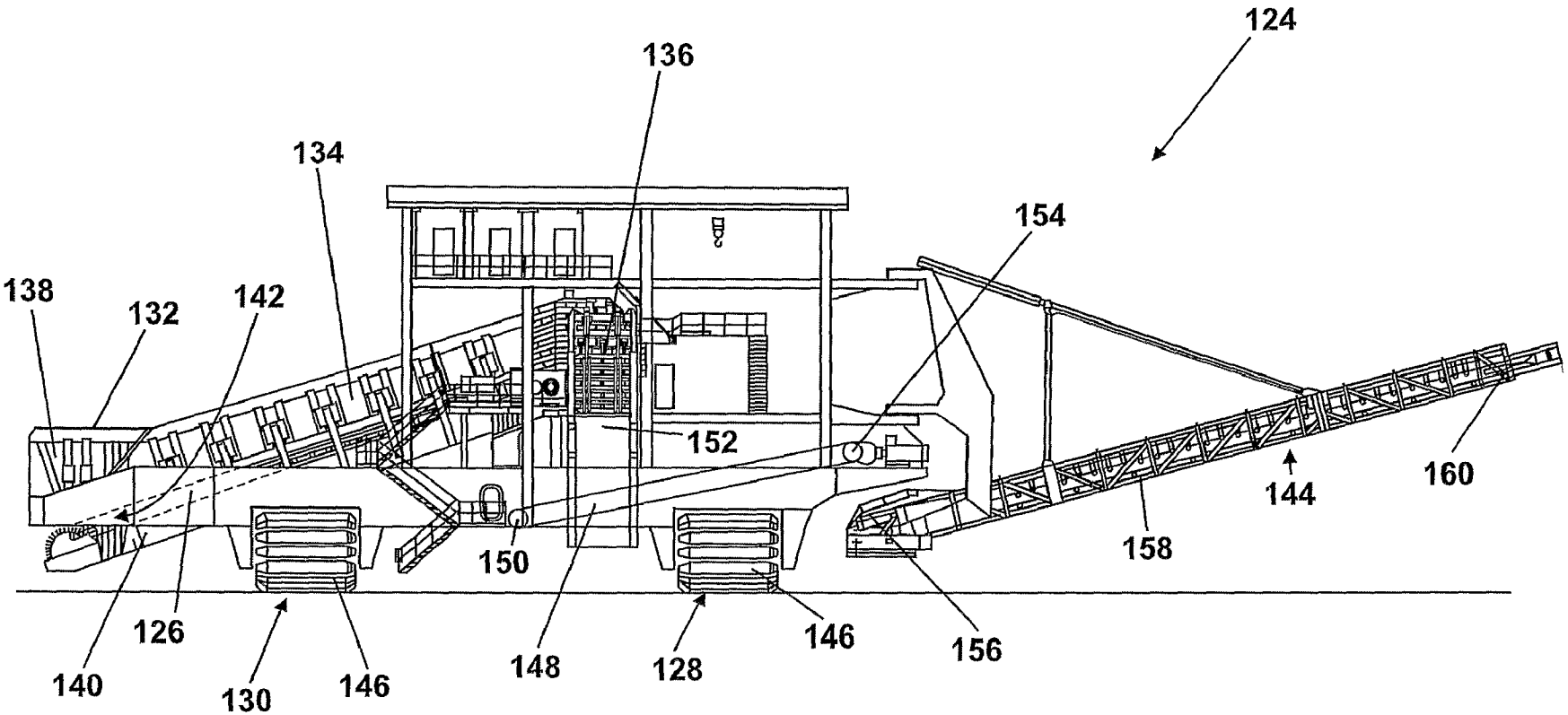
FIG. 14 is an elevational view of a mobile rig according to an fifth embodiment of the invention.

A mobile rig 124 according to a fifth embodiment of the invention is shown in FIG. 14.

The mobile rig 124 includes a main chassis 126 mounted on first and second transport carriages 128, 130.

The mobile rig 124 also includes a feed device in the form of a hopper 132 and a feeder conveyor 134 arranged to convey mineral deposited in the hopper 132 to an infeed region of a mineral breaker 136 mounted on the main chassis 126.

As with the previously described embodiments, the feeder conveyor 134 is preferably of a plate type having a continuous chain of flights. The hopper 132 is also preferably defined by hopper side walls 138 mounted on the support chassis 140 of the feeder conveyor 134 so as to extend along the sides of a support chassis 140 and across the feeder conveyor 134 at a mineral deposit end 142 of the feeder conveyor 134.

The mineral breaker 136 may be of any suitable type, but is preferably a mineral breaker of the type having a plurality of breaker drums such as, for example, one of the mineral breakers disclosed in European patents Nos. 0 167 178, 1 725 335 or 1 809 422.

A discharge conveyor 144 is also provided and arranged to convey mineral from a discharge region of the mineral breaker 136 to a downstream element, such as an overland removal conveyor (not shown).

The mobile rig 124 shown in FIG. 14 however differs from the previously described embodiments in that each of the first and second transport carriages 128, 130 includes a single, driven, ground-engaging track 146.

The first and second transport carriages 128, 130 are arranged in a spaced, parallel configuration and oriented relative to the main chassis 126 in a fixed transverse direction. This arrangement permits the use of a longer main chassis 126 to support the hopper 132 and the feeder conveyor 134.

The mobile rig 124 preferably includes one or more control devices for selectively driving the respective transport carriages 128, 130 at different speeds so as to effect steering of the mobile rig 124.

As in the third embodiment described with reference to FIGS. 10-12, the feeder conveyor 134 of the mobile rig 124 is shown extending between the hopper 132 and the main chassis 126 upwardly inclined relative to the ground at approximately 18° so as to minimize hang-up of mineral on the feeder conveyor 134.

The discharge conveyor 144 differs from the discharge conveyors of the embodiments shown in FIGS. 1-13 and includes a transfer section 148, a first end 150 of which is located below a discharge chute 152 of the mineral breaker 136 to receive mineral discharged via the discharge region of the mineral breaker 136.

The transfer section 148 of the discharge conveyor 144 extends at an angle from the first end 150 to a second end 154, which overlies a first end 156 of a discharge section 158 of the discharge conveyor 144.

The discharge section 158 of the discharge conveyor 144 extends at an angle from the first end 156 to a second end 160, and is pivotally connected to the main chassis 126 such that an operator is able to luff the discharge section 158 of the discharge conveyor 144 to accommodate changes in ground terrain while ensuring that the second end 160 of the discharge section 158 remains able to discharge onto a downstream element, such as an overland removal conveyor (not shown).

Figure 15:
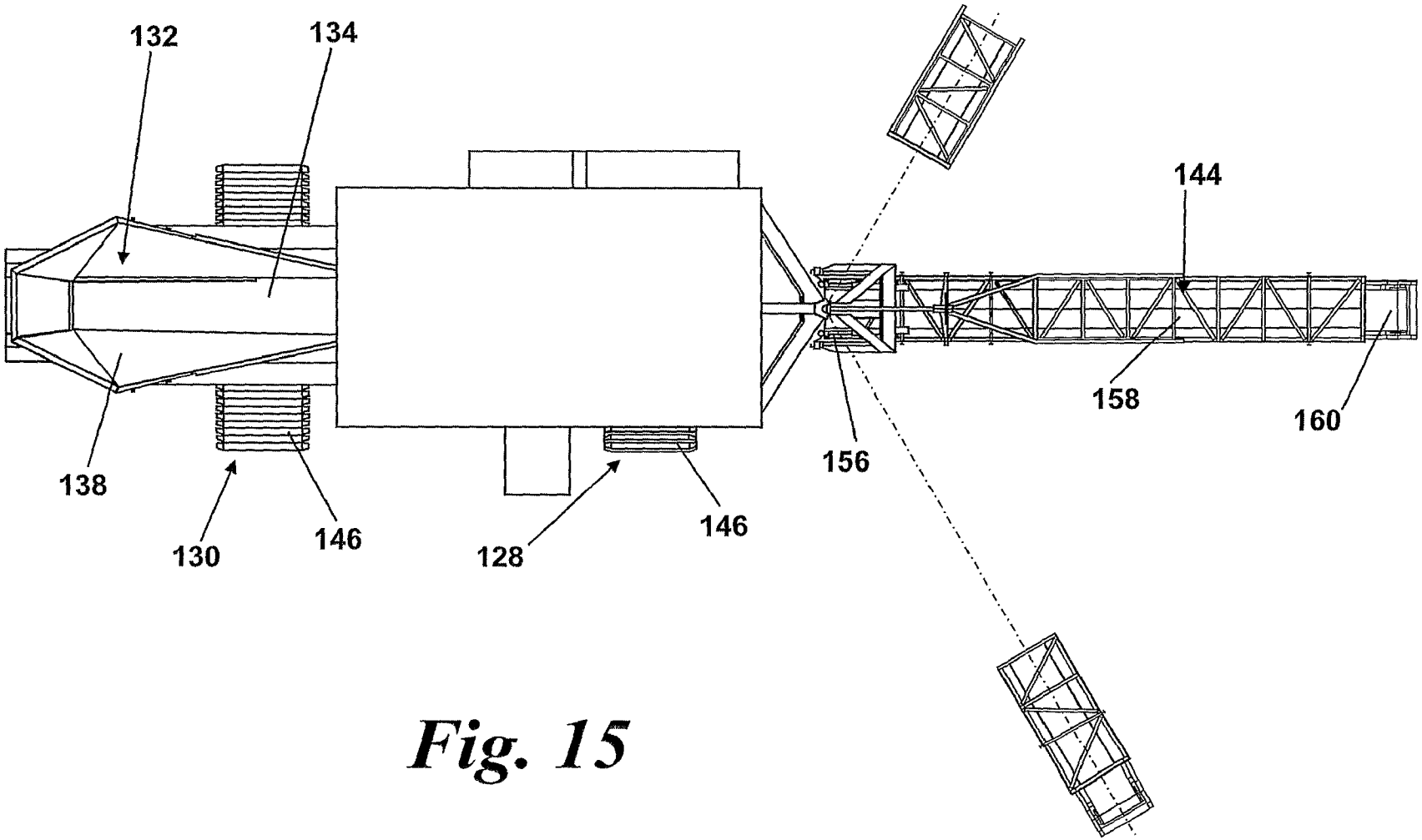
FIG. 15 is a plan view from above of the mobile rig shown in FIG. 17.

The transfer section 148 is hingedly connected to the main chassis 126 via hinges to permit slewing of the discharge section 158 relative to the main chassis 126 through a range of 120°, as shown by the dashed lines in FIG. 15. Slewing of the discharge section 158 relative to the main chassis 126 through ranges larger or smaller than 120° is also possible.

A slewing motor (not shown) is preferably provided to effect rotation of the discharge section 158 of the discharge conveyor 144. Rotation of the discharge section 158 may also be effected by one or more hydraulic cylinders.

In use the hopper 132 of the feed device is loaded with dug mineral, which is discharged from the hopper 132 onto the feeder conveyor 134 which transfers it to an infeed region of the mineral breaker 136.

Following introduction into the mineral breaker 136 via the infeed region of the mineral breaker 136, the mineral is processed to ensure that it contains no lumps over a desired size before being discharged via the discharge chute 152 in the discharge region of the mineral breaker 136 onto the first end 150 of the transfer section 148 of the discharge conveyor 144.

The mineral is then conveyed from the first end 150 of the transfer section 148 of the discharge conveyor 144 to the second end 154 of the transfer section 148 of the discharge conveyor 144 for discharge onto the first end 156 of the discharge section 158 of the discharge conveyor 144. The mineral is then conveyed from the first end 156 of the discharge section 158 of the discharge conveyor 144 to the second end 160 of the discharge section 158 where the mineral is discharged to a downstream element (not shown).

Figure 16:
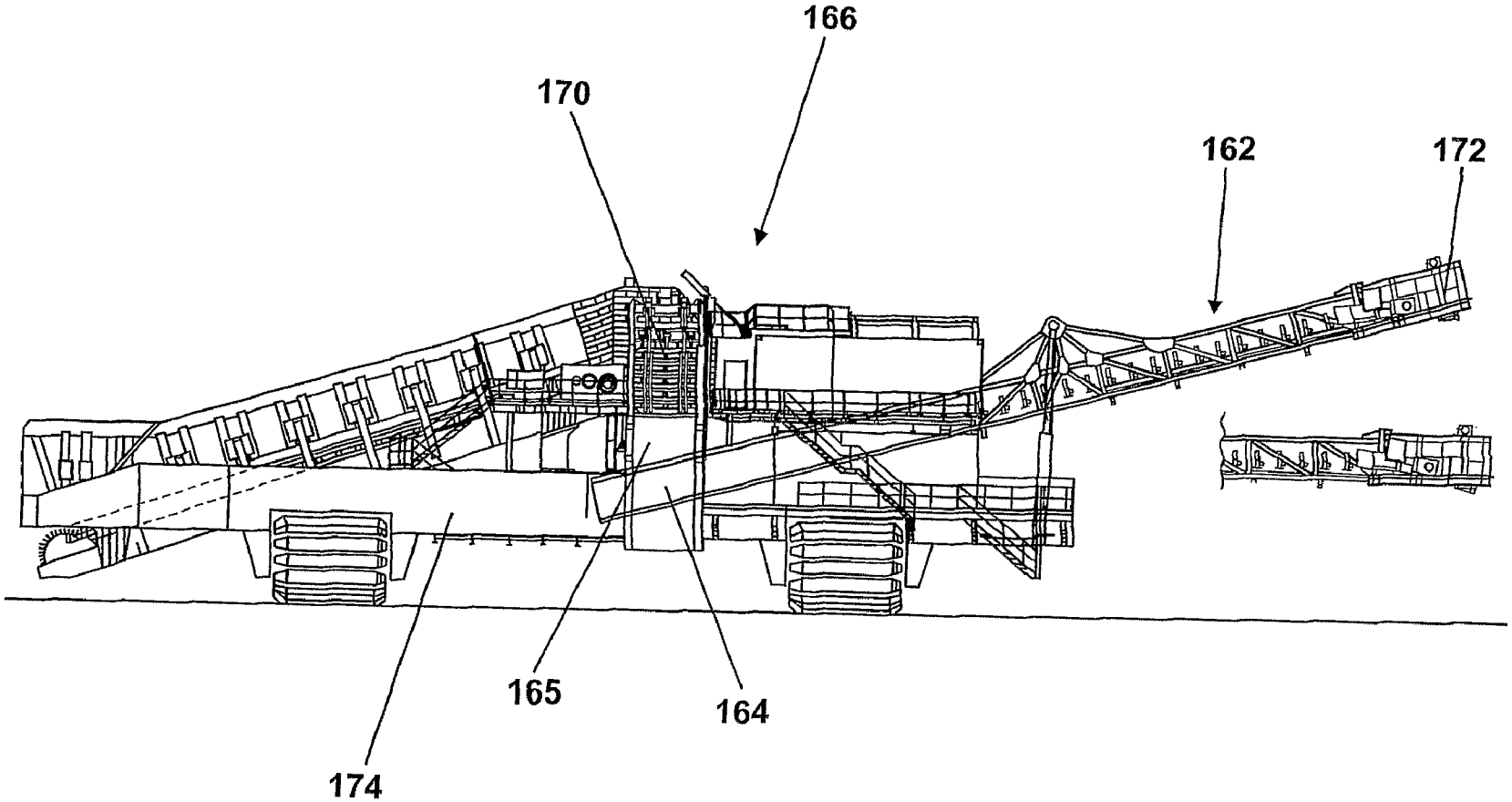
FIG. 16 is an elevational view of a mobile rig according to a sixth embodiment of the invention.

In other similar embodiments, such as that shown in FIG. 16, a non-slewing discharge conveyor 162 may be provided.

As can be seen from FIG. 16, the discharge conveyor 162 in such embodiments has essentially the same structure as the discharge conveyor of the mobile rigs shown in FIGS. 1-4 and 8-12.

As in the embodiments shown in FIGS. 1-4 and 8-12, a first end 164 of the discharge conveyor 162 of the mobile rig 166 shown in FIG. 16 is located below a discharge chute 168 of a mineral breaker 170 to receive mineral discharged via the discharge region of the mineral breaker 170.

The discharge conveyor 162 extends at an angle from the first end 164 to a second end 172, and is pivotally connected to the main chassis 174 such that an operator is able to luff the discharge conveyor 162 to accommodate changes in ground terrain while ensuring that the second end 172 of the discharge conveyor 162 remains able to discharge onto a downstream element, such as an overland removal conveyor (not shown). Luffing cylinders may interconnect the discharge conveyor 162 and the main chassis 174 for this purpose.

Figure 17:
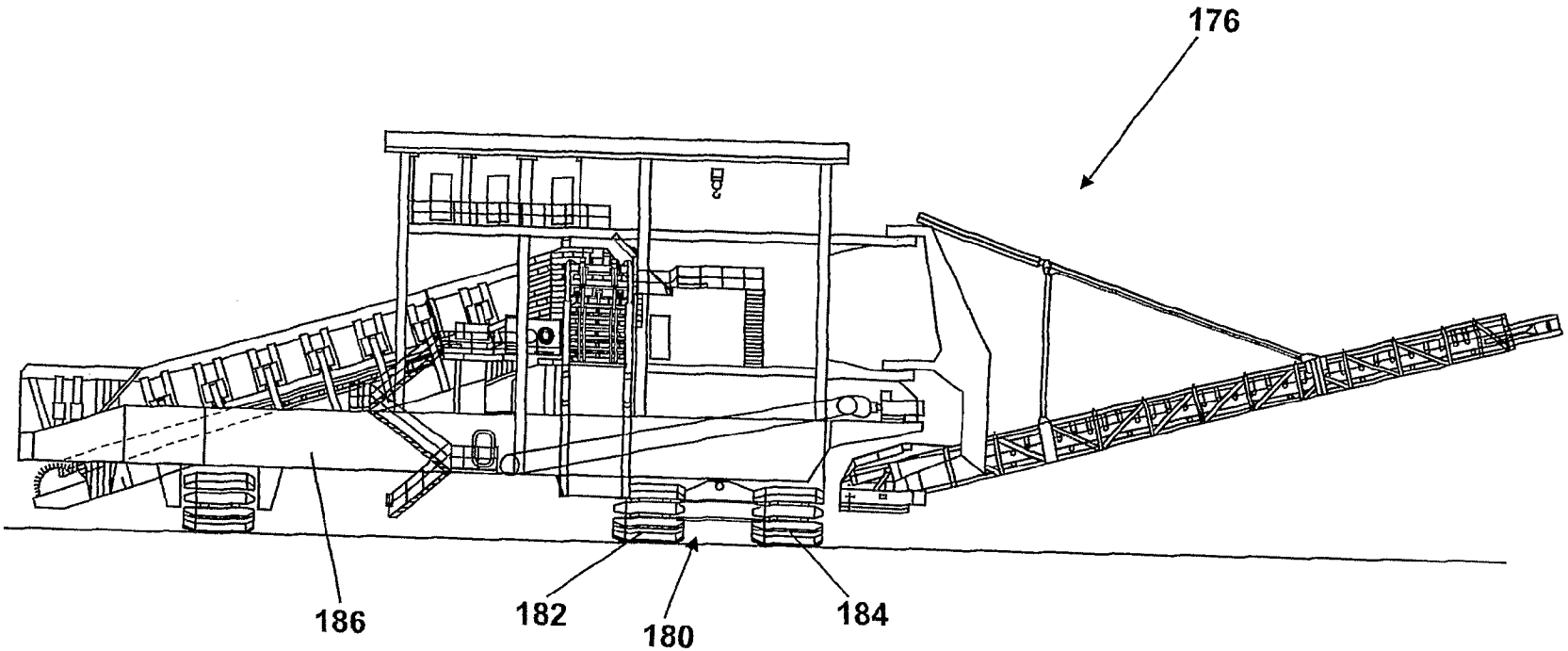
FIG. 17 is an elevational view of a mobile rig according to a seventh embodiment of the invention.
Figure 18:
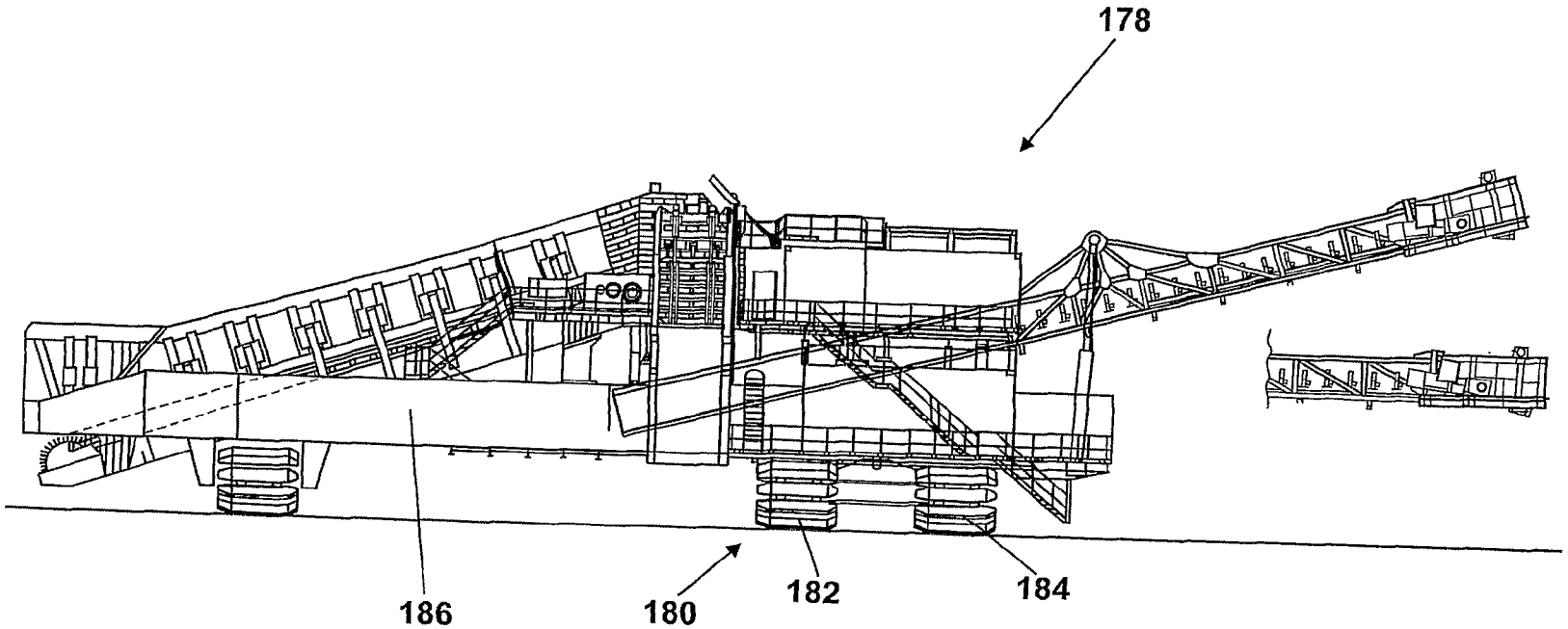
FIG. 18 is an elevational view of a mobile rig according to a eighth embodiment of the invention.

Mobile rigs 176, 178 according to seventh and eighth embodiments of the invention are shown in FIGS. 17 and 18 respectively.

The mobile rigs 176, 178 shown in FIGS. 17 and 18 are essentially the same as the mobile rigs 124, 166 shown in FIGS. 14 and 16 respectively.

However in each of the mobile rigs 176, 178 shown in FIGS. 17 and 18 the first transport carriage 180 differs from the first transport carriage 128, 182 of the mobile rigs 124, 166 shown in FIGS. 14 and 16 in that it includes a pair of parallel, driven, ground-engaging tracks 182, 184.

In these embodiments, the main chassis 186 is pivotally supported on the first transport carriage 180 to negotiate ground undulations without significantly altering the orientation of the main chassis 186.

In such embodiments the mobile rigs 176, 178 preferably include one or more control devices for selectively driving the respective tracks 182, 184 at different speeds so as to effect steering of the mobile rigs 176, 178.

Figure 19:
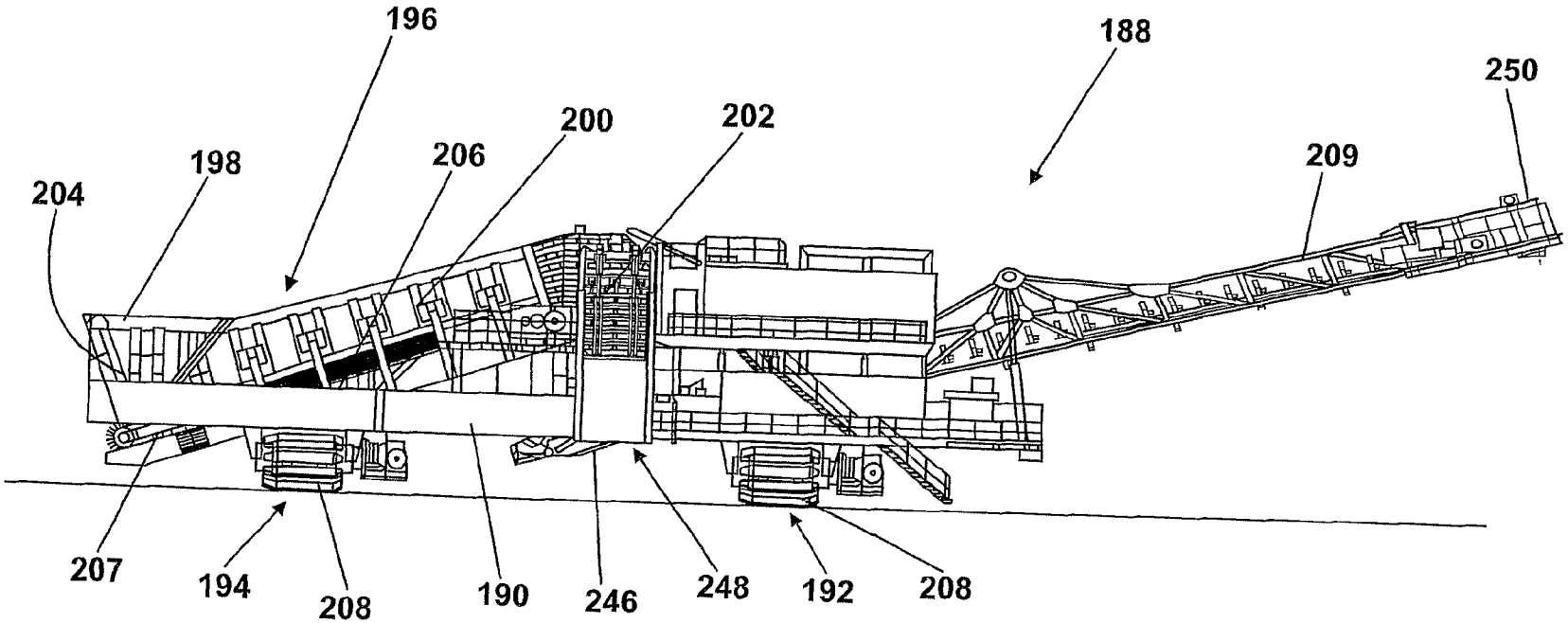
FIG. 19 is an elevational view of a mobile rig according to a ninth embodiment of the invention.

A mobile rig 188 according to an ninth embodiment of the invention is shown in FIG. 19 and includes a main chassis 1.90 mounted on first and second transport carriages 192, 194.

The mobile rig 188 also includes a feed device 196 in the form of a hopper 198 and a feeder conveyor 200 arranged to convey mineral deposited into the hopper 198 to an infeed region of a mineral breaker 202 mounted on the main chassis 190.

The feeder conveyor 200 is preferably of a plate type having a continuous chain of flights. The hopper 198 is preferably defined by hopper side walls 204 mounted on a support chassis 206 of the feeder conveyor 200 so as to extend along the sides of the support chassis 206 and across the feeder conveyor 200 at a mineral deposit end 207 of the feeder conveyor 200.

The mineral breaker 202 may be of any suitable type, but is preferably a mineral breaker of the type having a plurality of breaker drums such as, for example, one of the mineral breakers disclosed in European patents Nos. 0 167 178, 1 725 335 or 1 809 422.

In the embodiment shown in FIG. 19, the breaker drums of the mineral breaker 202 extend laterally across the width of the main chassis 190. In other embodiments the breaker drums may extend along the length of the main chassis 190, or at another angle relative to the length of the main chassis 190.

A discharge conveyor 209 is also provided and arranged to convey mineral from a discharge region of the mineral breaker 202 to a downstream element, such as an overland removal conveyor (not shown).

The first and second transport carriages 192, 194 each includes a single, driven, ground-engaging track 208 and are arranged such that the ground-engaging tracks 208 are located in a spaced, parallel configuration and oriented relative to the main chassis 190 in a fixed transverse direction. This arrangement permits the use of a longer main chassis 190 to support the hopper 198 and the feeder conveyor 200.

In other embodiments the second transport carriage 194 may include a pair of parallel, driven, ground-engaging tracks.

The mobile rig 188 includes one or more control devices (not shown) for selectively driving the respective said ground-engaging tracks 208 at different speeds and in different directions, as required, so as to control movement of the rig 188 and effect steering thereof.

The ground-engaging track 208 of the first transport carriage 192 is pivotally mounted on the main chassis 190 to allow pivotal movement of the ground-engaging track 208 relative to the main chassis 190 in a plane generally parallel to the-transverse direction.

The ground-engaging track 208 of the second transport carriage 194 is, in contrast, fixedly mounted on the main chassis 190. In other embodiments of the invention the ground-engaging track 208 of the second transport carriage 194 may be pivotally mounted on the main chassis 190 to allow pivotal movement of the ground-engaging track 208 relative to the main chassis 190 in a plane generally parallel to the transverse direction.

Figure 20:
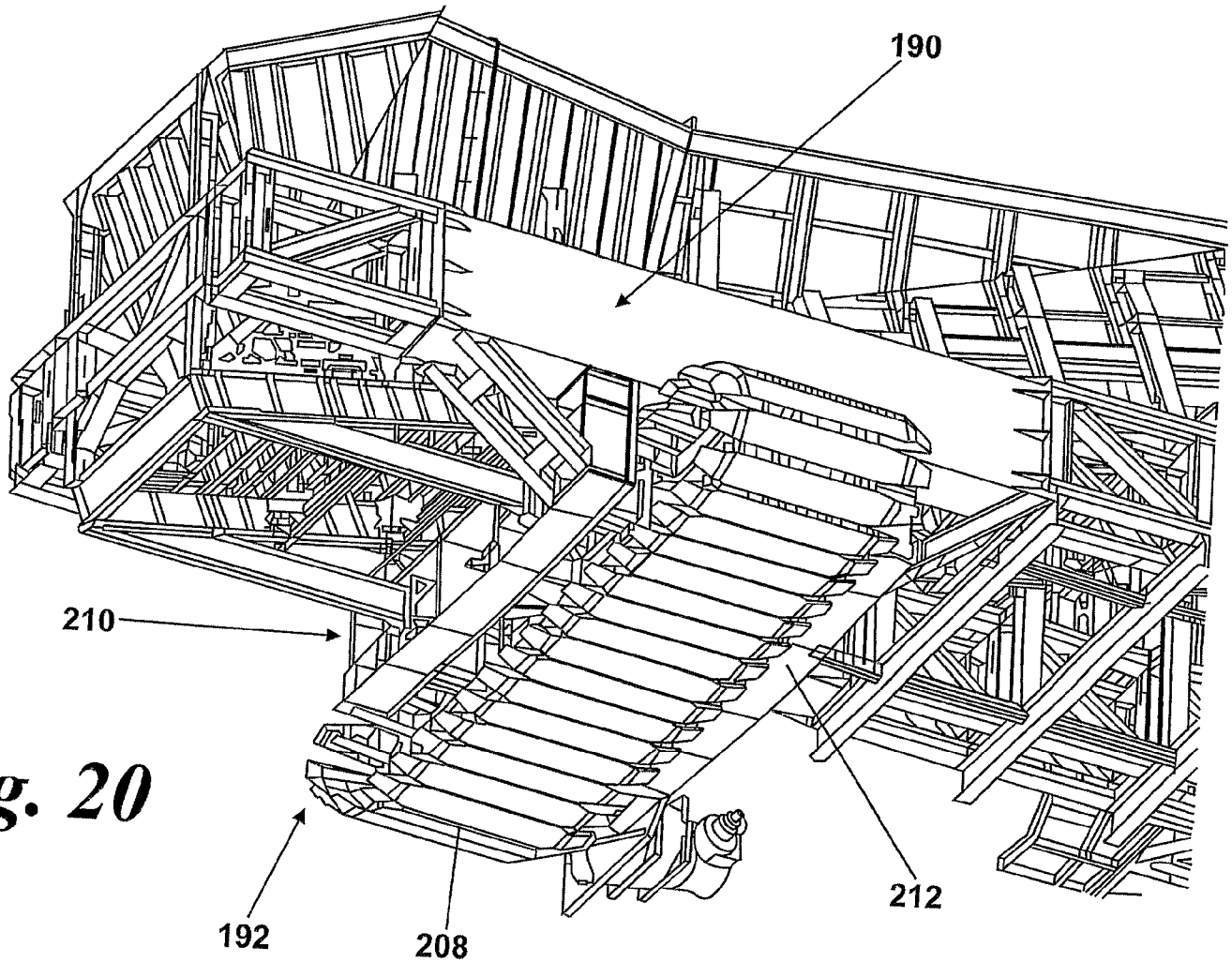
FIG. 20 is a perspective view from below of a first transport carriage of the mobile rig shown in FIG. 19.

In order to pivotally mount the ground-engaging track 208 of the first transport carriage 192, for example, on the main chassis 190, the ground-engaging track 208 is mounted between a pair of opposed frame elements 210, 212 as shown in FIG. 20, which extend from the underside of the main chassis 190.

Figure 21:
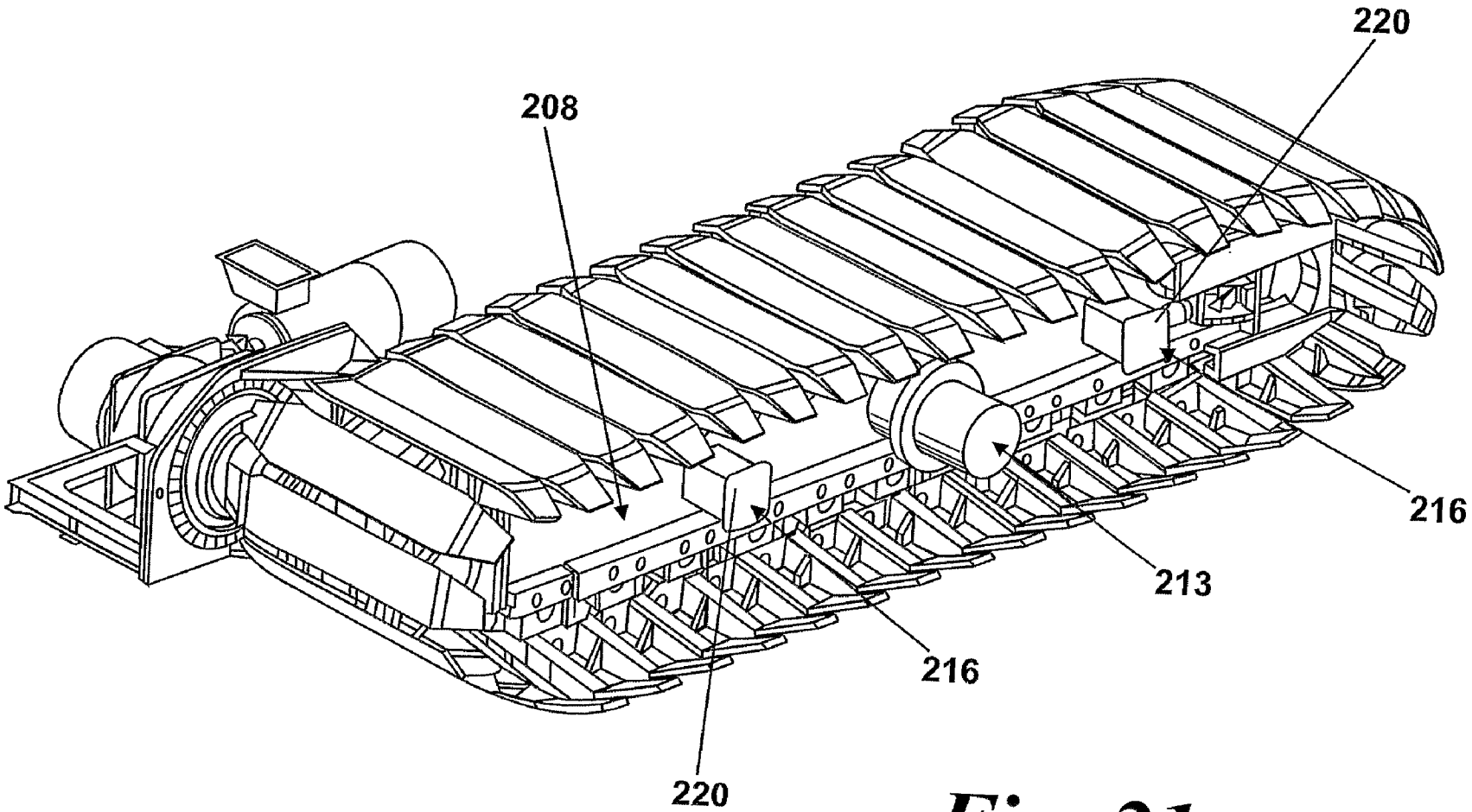
FIGS. 21 and 22 show a ground-engaging track and a frame element of the first transport carriage shown in FIG. 20.

Each frame element 210, 212 includes a pivot shaft bearing 214 (FIG. 23) to receive a pivot shaft 213 (FIG. 21) extending from a respective side of the ground-engaging track 208 so as to define co-axial pivot joints 215 (FIG. 22) on opposite sides of the ground-engaging track 208. Such pivotal connections allow the ground-engaging track 208 to pivot about a pivot axis A defined by the pivot joints 215 in response to undulations in the ground over which the mobile rig 188 is moved. This in turn allows contact between the ground and the ground-engaging tracks 208 to be maximized in circumstances where the slope of the ground under each of the ground-engaging tracks 208 differs. It therefore permits distribution of load to the ground-engaging tracks 208 and reduces the risk of any twisting forces being transmitted to the main chassis 190.

The provision of pivotal joints 215 to pivotally mount the ground-engaging track 208 of the first transport carriage 192 between the opposed frame elements 210, 212 renders the ground-engaging track 208 vulnerable to rotational turning moments. This is particularly so in circumstances where the first transport carriage 192 sinks into soft ground. During steering of the mobile rig 188 in such conditions relatively large rotational turning moments are applied to the ground-engaging track 208 of the first transport carriage 192. So as to avoid such rotational turning moments being transmitted to the pivot joints 215 and thereby damaging the pivot joints, a buffer assembly 214 is provided on each side of each pivot joint 215 to resist movement of the ground-engaging track 208 towards either frame element 210, 212 on either side of each pivot joint 215.

Figure 22:
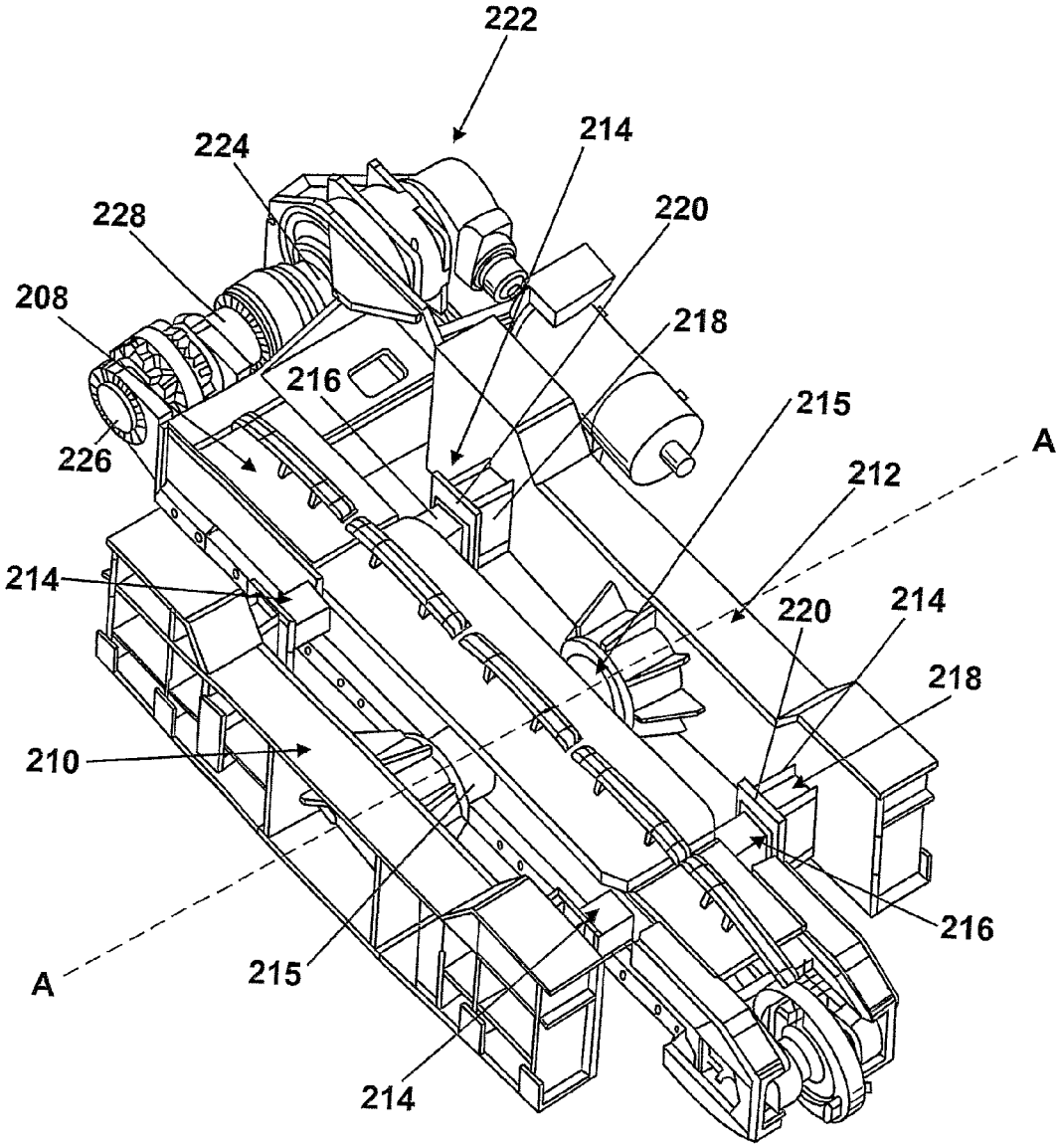
Figure 23:
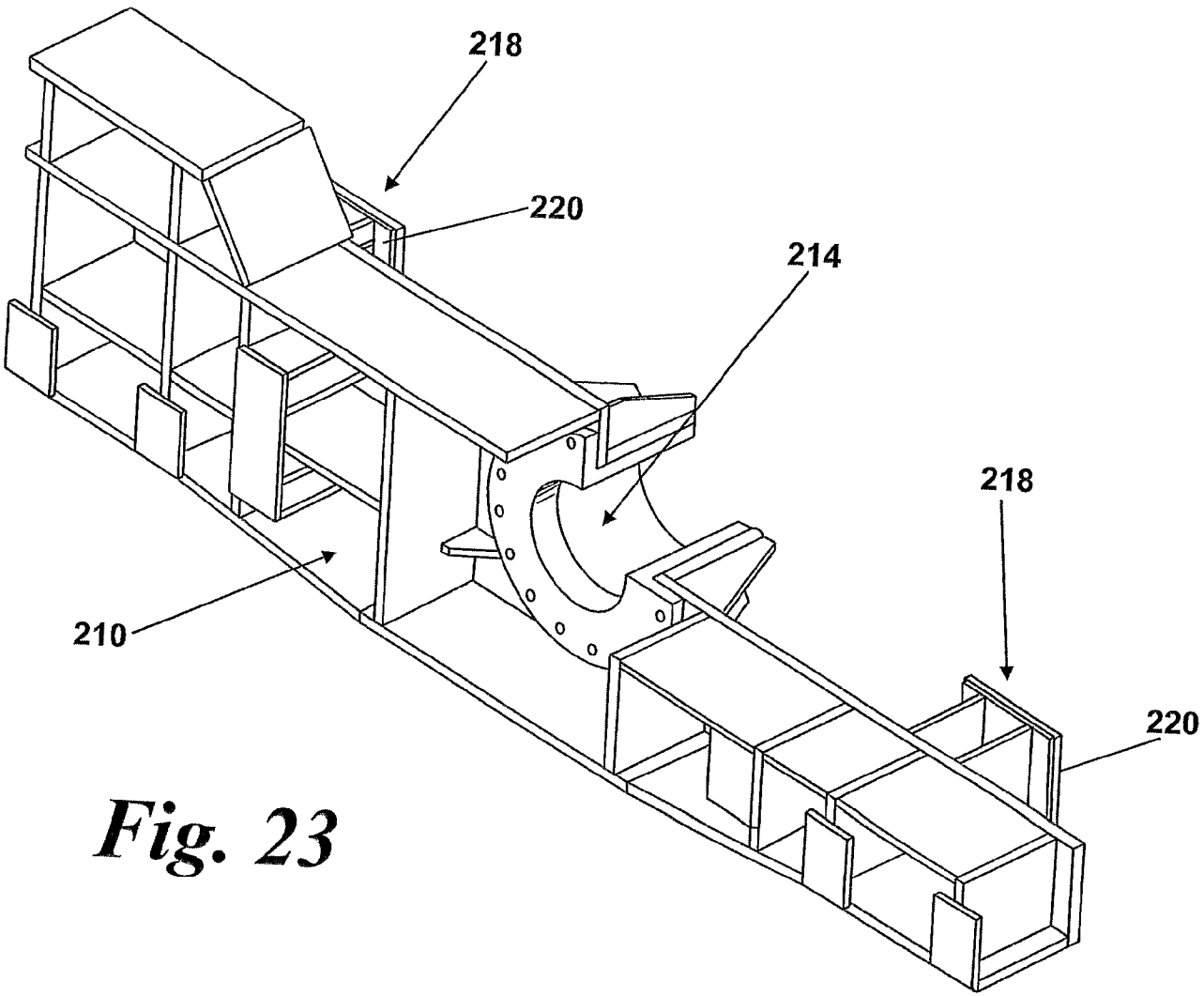
FIG. 23 shows a frame element of the first transport carriage shown in FIG. 20.

In the embodiment shown in FIG. 19, each buffer assembly 214 includes a buffer element 216 extending from a respective side of the ground-engaging track 208, as shown in FIG. 22. Each buffer assembly 214 also includes a corresponding buffer element 218 extending from the respective frame element 210, 212, as shown in FIG. 22. The corresponding buffer elements 216, 218 extending from the ground-engaging track 208 and the frame elements 210, 212 are aligned such that buffer faces 220 on the corresponding buffer elements 216, 218 abut each other. This abutment resists movement of the ground-engaging track 208 towards the respective frame element 210,212 in the event a rotational turning moment is applied to the ground-engaging track 208.

Spacing of the buffer assemblies 214 on each side of the respective pivot joints allows any rotational turning moments applied to the ground-engaging track 208 to be distributed along the length of the ground-engaging track 208 and frame elements 210, 212, allowing the ground-engaging track 208 and frame elements 210, 212 to absorb the rotational turning moments and minimize the risk of damage to the pivotal joints.

If the buffer assemblies 214 were omitted, counterbalancing of any rotational turning moments would be provided solely by the pivotal joints rendering the pivotal joints susceptible to damage, which would threaten their mechanical integrity.

In the event that manufacturing tolerances lead to gaps between the buffer faces 220 of corresponding buffer elements shims (not shown) may be located between the buffer faces 220. This ensures that contact between the buffer elements 216, 218 minimizes the risk of any twisting movement of the ground-engaging track 208 between the frame elements 210, 212.

To ensure that abutting contact is also maintained through the range of pivotal movement of the ground-engaging track 208 relative to the main chassis 190, the buffer faces 220 of the buffer elements 218 extending from the frame elements 210, 212 are elongated. This allows the buffer faces 220 of the corresponding buffer elements 216 extending from the ground-engaging track 208 to slide along the elongated buffer faces 220 during pivotal movement of the ground-engaging track 208 relative to the main chassis 190.

It is envisaged that in other embodiments the buffer faces 220 on the buffer elements 216 extending from the ground-engaging track 208 may be elongated in addition or as an alternative to the arrangement described above.

In the embodiment shown in FIG. 19, a gearbox 222 is mounted on one of the frame elements 212 of the first transport carriage 192 to control drive to the ground-engaging track 208. Drive is transferred from the gearbox 222 to the ground-engaging track 208 by means of a drive shaft 224 extending from the gearbox 222 and a drive shaft 226 coupled to the ground-engaging track 208. To allow for pivotal movement of the ground-engaging track 208 relative to the frame element 210, 212, and therefore relative displacement of the drive shafts 224, 226, a gear coupling 228 having a floating sleeve 230 is used to couple the drive shafts 224, 226, as shown in FIG. 22. The floating sleeve 230 acts as an intermediary member to transmit drive from one drive shaft to the other drive shaft and therefore allows coupling of the drive shafts 224, 226 to be maintained (within certain limits) during both angular and radial misalignment between ends of the drive shafts 224, 226.

Figure 24:
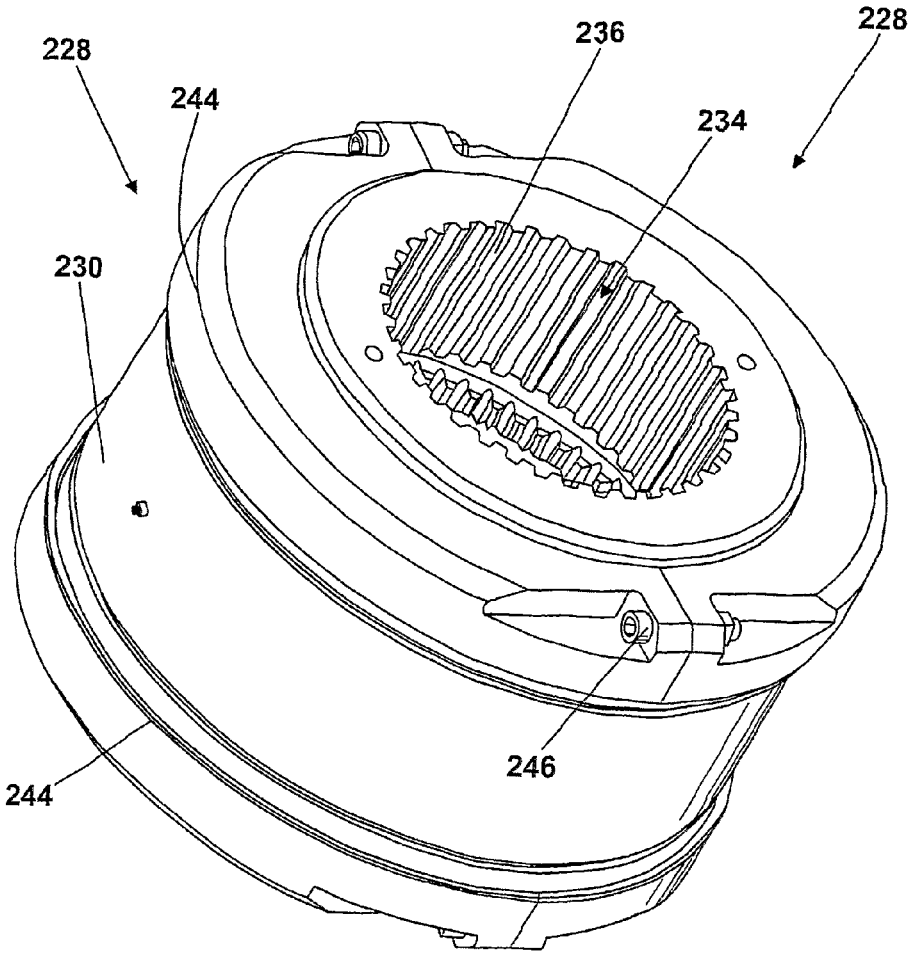
FIGS. 24 and 25 show a gear coupling of the first transport carriage shown in FIG. 20.
Figure 25:
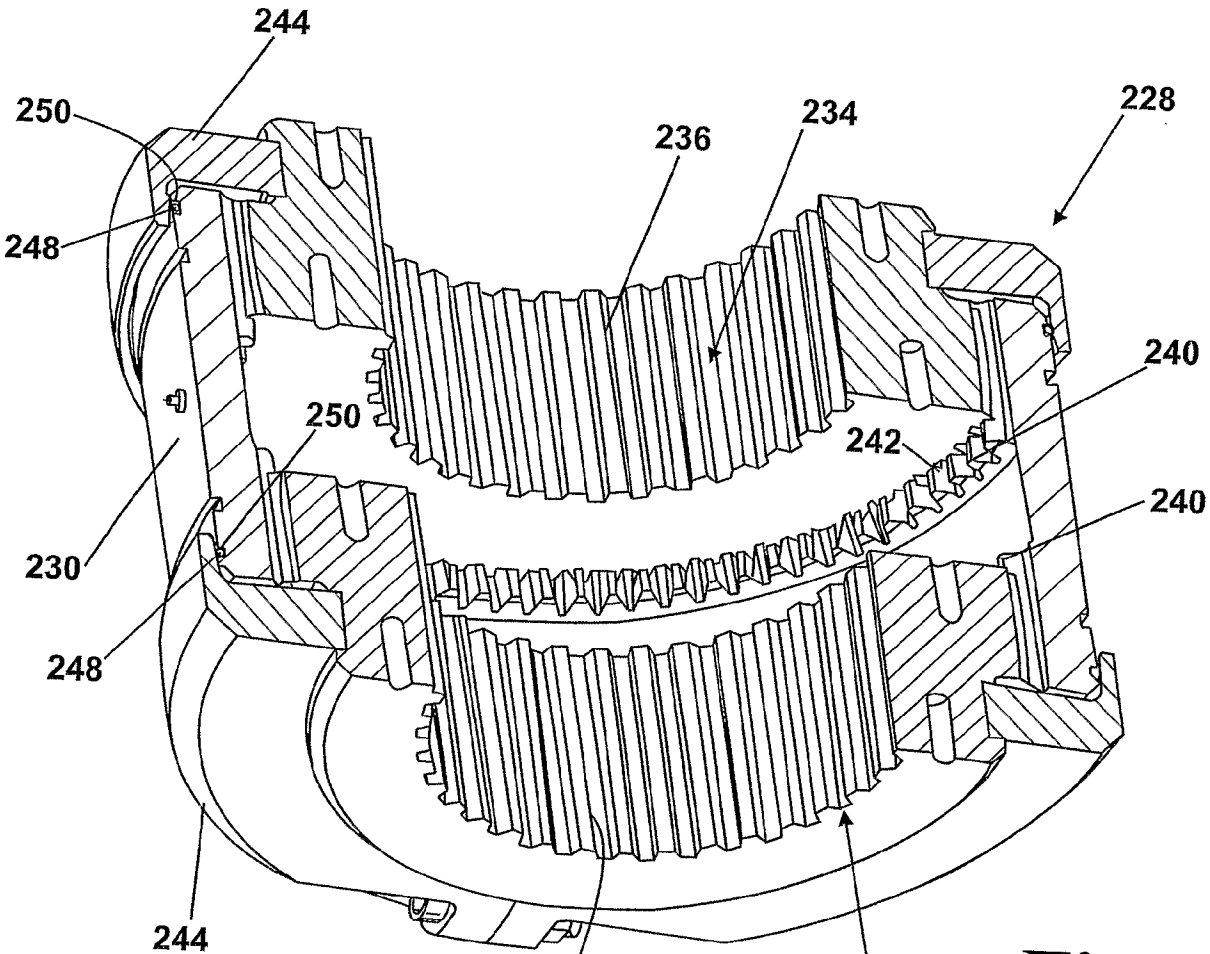

The gear coupling 228 is shown in FIGS. 24 and 25 and includes first and second hubs 232, 234 (FIG. 25).

The hubs 232, 234 are formed to define internal splines 236, each of which engages external gear teeth (not shown) provided on the end of a respective one of the drive shafts 224, 226.

The hubs 232,234 are received within the floating sleeve 230, which is formed to define internal gear teeth 240, which engage external gear teeth 242 on the hubs 232, 234.

The hubs 232, 234 are retained within the floating sleeve 230 by means of end clamps 244 (FIG. 24), each of which is formed in two halves to allow location thereof about the hubs 232, 234 and the floating sleeve 230 before being secured together by means of bolts 246. An inner flange 248 provided within each end clamp 244 is received within a recess 250 formed in the outer surface towards a respective end of the floating sleeve 230 to prevent separation of the components. The end clamps 244 therefore prevent axial movement of the floating sleeve 230 relative to the hubs 232, 234 and therefore relative to the drive shafts 224, 226.

Engagement between the external gear teeth on the gearbox drive shaft 224 and the internal spline 236 of the respective hub 234 causes rotation of the hub 234 which in turn causes rotation of the floating sleeve 230 by virtue of engagement between the external gear teeth 242 on the hub 234 and the internal gear teeth 240 in the floating sleeve 230.

Engagement between the internal gear teeth 240 in the floating sleeve 230 and the external gear teeth 242 of the hub 232 provided on the end of the ground-engaging track drive shaft 226 causes rotation of the hub 232, which in turn causes rotation of the ground-engaging track drive shaft 226 through engagement between the internal spline 236 of the hub 232 and the external gear teeth on the ground-engaging drive shaft 226.

The external gear teeth 242 of the hubs 232, 234 are crowned so as to define a rounded tooth profile. This configuration ensure that the floating sleeve 230 is not rigidly connected to either of the hubs 232, 234 and therefore allows driving engagement between the external gear teeth 242 of the hubs 232, 234 and the internal gear teeth 240 in the floating sleeve 230 to be maintained when the two hubs 232, 234 are out of radial and/or angular alignment. This is because it allows the floating sleeve 230 to move relative to the hubs 232, 234 and thereby adjust to so as to maintain torsional connection of the hubs 232, 234 even when the ends of the drive shafts 224, 226 are misaligned.

In the embodiment shown in FIG. 19 the feeder conveyor 200 is fixed at an angle of approximately 18° relative to level ground, this being an optimized angle of conveyance that prevents material hang-up when considering one particular type of material.

As explained earlier with reference to the other embodiments, other minimum conveyance angles may be suitable for different materials although typically they will be around the value of 18° and in the range of 15-22° to level ground.

A first end 246 of the discharge conveyor 209 is located below a discharge chute 248 of the mineral breaker 202 to receive mineral discharged via the discharge region of the mineral breaker 202.

The discharge conveyor 209 extends at an angle from the first end 246 to a second end 250, and is pivotally connected to the main chassis 190 such that an operator is able to lull the discharge conveyor 209 to accommodate changes in ground terrain while ensuring that the second end 250 of the discharge conveyor 209 remains able to discharge onto a downstream element, such as an overland removal conveyor (not shown). Luffing cylinders may interconnect the discharge conveyor 209 and the main chassis 190 for this purpose.

In use the hopper 198 of the feed device is loaded with dug mineral, which is discharged from the hopper onto the feeder conveyor 200 for conveyance to the infeed region of the mineral breaker 202.

Following introduction into the mineral breaker 202 via the infeed region of the mineral breaker 202, the mineral is processed to ensure that it contains no lumps over a desired size before being discharged via the discharge chute 248 in the discharge region of the mineral breaker 202 onto the first end 246 of the discharge conveyor 209.

The mineral is then conveyed from the first end 246 of the discharge conveyor 209 to the second end 250 of the discharge conveyor 209 for discharge onto a downstream element (not shown).

Use of the mineral breaker disclosed in European patent application No. 1 725 335 allows oversized material which cannot be broken by the mineral breaker 202 and cannot therefore be discharge via the discharge chute 248 to be removed from the mineral processing route defined by the mobile rig 188. The oversized material is preferably removed by means of a chute (not shown), extending from an opposite side of the mineral breaker 202 to the infeed region, to a receptacle.

In another embodiment not shown in the drawings, the discharge conveyor 209 may be constructed to include a first, transfer section fixed generally parallel to level ground below the discharge chute 248 of the mineral breaker 202 to receive and convey mineral from the discharge region of the mineral breaker 202 towards a second, discharge section of the discharge conveyor 209, as described earlier with reference to the mobile rig 110 shown in FIG. 13. In other embodiments of the invention the first section may be fixed at an angle of up to 15° to level ground.

In a yet further embodiment not shown in the drawings, the discharge conveyor 209 may be constructed to include transfer and discharge sections as described earlier with reference to the mobile rigs 124, 176 shown in FIGS. 14, 15 and 17.

Figure 27:
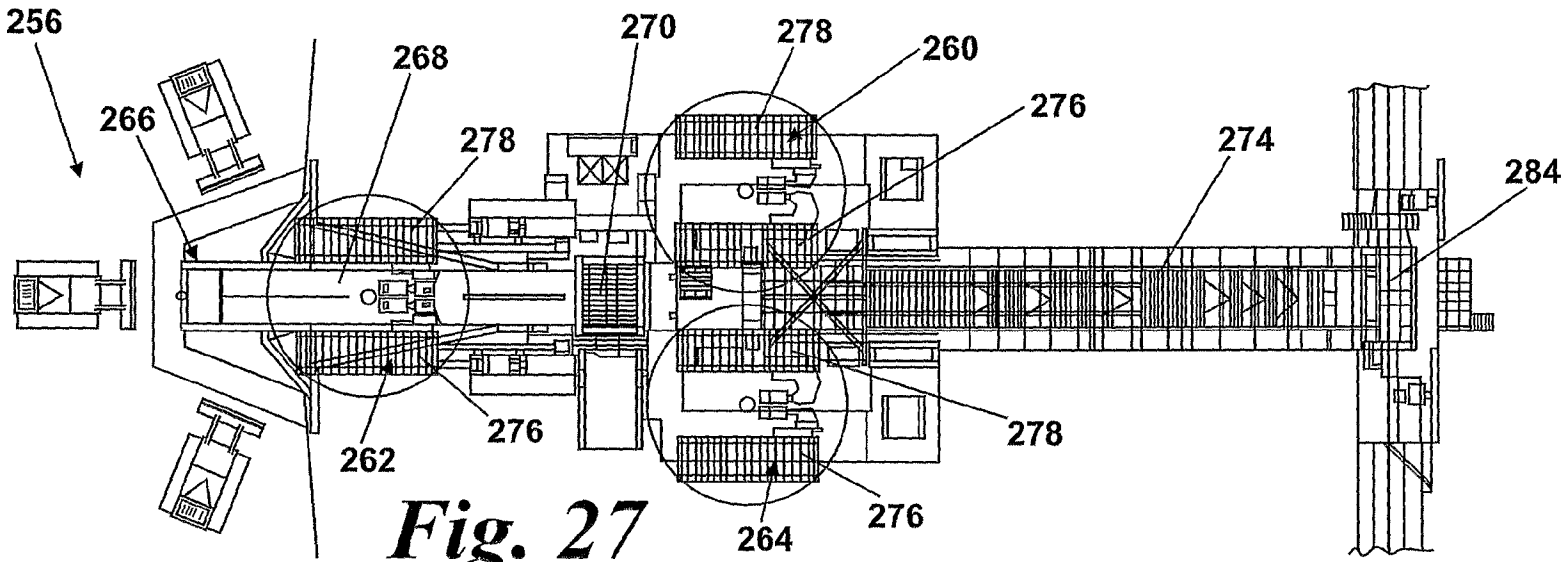
FIG. 27 is a plan view from above of the mobile rig shown in FIG. 26.
Figure 26:
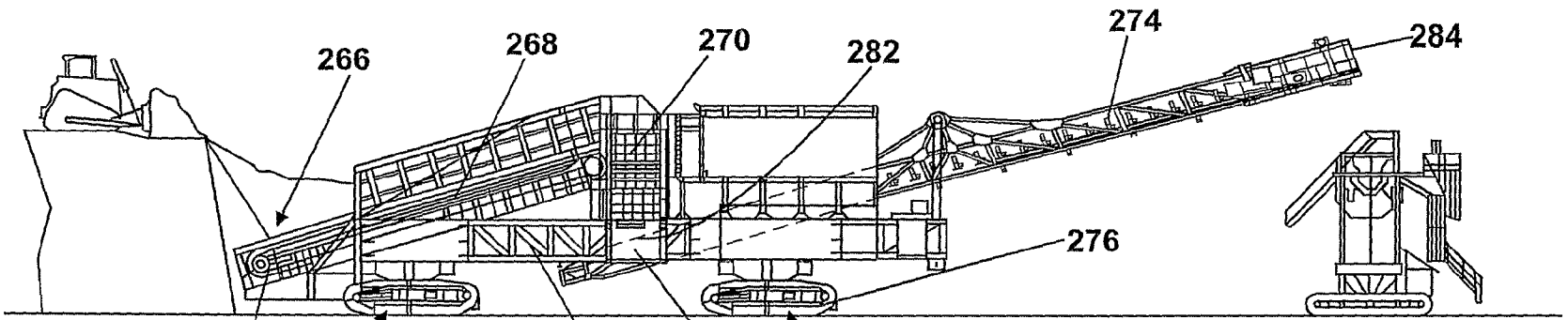
FIG. 26 is an elevational view of a mobile rig according to a tenth embodiment of the invention showing first, second and third transport carriages of the mobile rig in a first orientation relative to a main chassis.

A mobile rig 256 according to a tenth embodiment of the invention is shown in FIGS. 26 and 27, and includes a main chassis 258 mounted on first, second and third transport carriages 260, 262, 264.

The mobile rig 256 also includes a feed device in the form of an in-ground feeder hopper 266 and a feeder conveyor 268 arranged to convey mineral deposited in the in-ground feeder hopper 266 to an infeed region of a mineral breaker 270 mounted on the main chassis 258.

The feeder conveyor 268 is preferably of a plate type having a continuous chain of flights.

In contrast to the previously described embodiments, the in-ground feeder hopper 266 is preferably defined by walls of e.g. compacted mineral erected to surround the sides and end of a mineral deposit end 272 of the feeder conveyor 268.

Such a hopper arrangement is advantageous in circumstances where the mobile rig 256 can be located below the mining operation since it may be arranged such that mineral can be swept from the mining floor, above the in-ground hopper 266, directly into the in-ground hopper 266. This arrangement can be used to improve efficiency and rate at which mineral can be loaded into the hopper since it removes the need to lift the mineral for deposit into the hopper. It also means that less accuracy is required to deliver the mineral since the sloped side walls of compacted mineral direct the mineral towards the mineral deposit end 272 of the feeder conveyor 268.

The provision of sloped side walls of compacted mineral, and sweeping the mineral down these side walls, also serves to reduce the impact of the mineral onto the mineral deposit end of the feeder conveyor thereby reducing the amount of wear to the feeder conveyor 268.

It is envisaged that in other embodiments the in-ground feeder hopper 266 may be replaced by a hopper defined by hopper side walls mounted on a support chassis of the feeder conveyor 268, such as is shown in FIGS. 1-4 for example.

The mineral breaker 270 of the mobile rig 256 shown in FIGS. 26 and 27 may be of any suitable type, but is preferably a mineral breaker of the type having a plurality of breaker drums such as, for example, one of the mineral breakers disclosed in European patents Nos. 0 167 178, 1 725 335 or 1 809 422.

In the embodiment shown in FIGS. 26 and 27, the breaker drums of the mineral breaker 270 extend laterally across the width of the main chassis 258. In other embodiments the breaker drums may extend along the length of the main chassis 258, or at another angle relative to the length of the main chassis 258.

A discharge conveyor 274 is also provided and arranged to convey mineral from a discharge region of the mineral breaker 270 to a downstream element, such as an overland removal conveyor (not shown).

The first, second and third transport carriages 260, 262, 264 each includes a pair of parallel, driven, ground-engaging tracks 276, 278 located in a spaced configuration such that the first and third transport carriages 260, 264 are spaced in a lengthwise direction of the main chassis 258 from the second transport carriage 262 and the first and third transport carriages 260, 264 are spaced in a widthwise direction of the main chassis 258.

In this arrangement the location of the second transport carriage 262 from the first and third transport carriages 260, 264 permits the use of a longer chassis 258 to support the feeder conveyor 268.

The location of the first and third transport carriages 260, 264 provides additional support to the main chassis 258 below the mineral breaker 270 where the main chassis 258 is generally wider. It therefore improves the stability of the main chassis 258.

Each of the first, second and third transport carriages 260, 262, 264 is rotatably coupled to the main chassis 258 to allow steering of the mobile rig 256 during movement.

Figure 29:
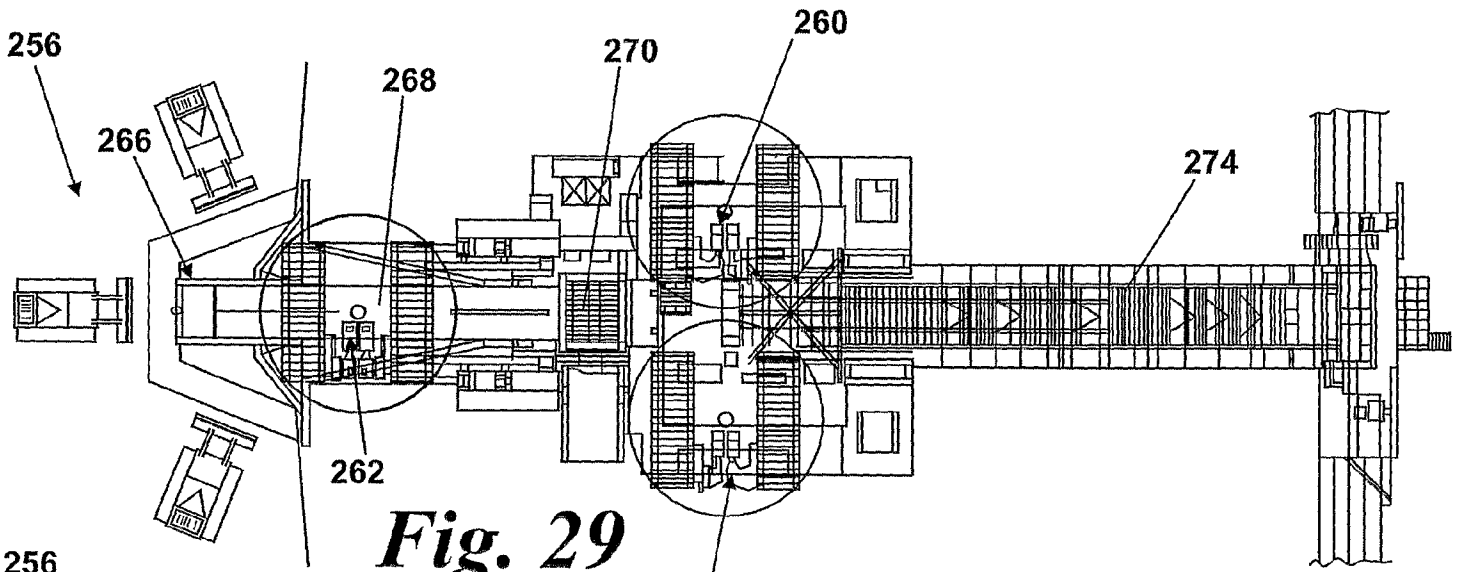
FIG. 29 is a plan view from above of the mobile rig shown in FIG. 28.
Figure 28:
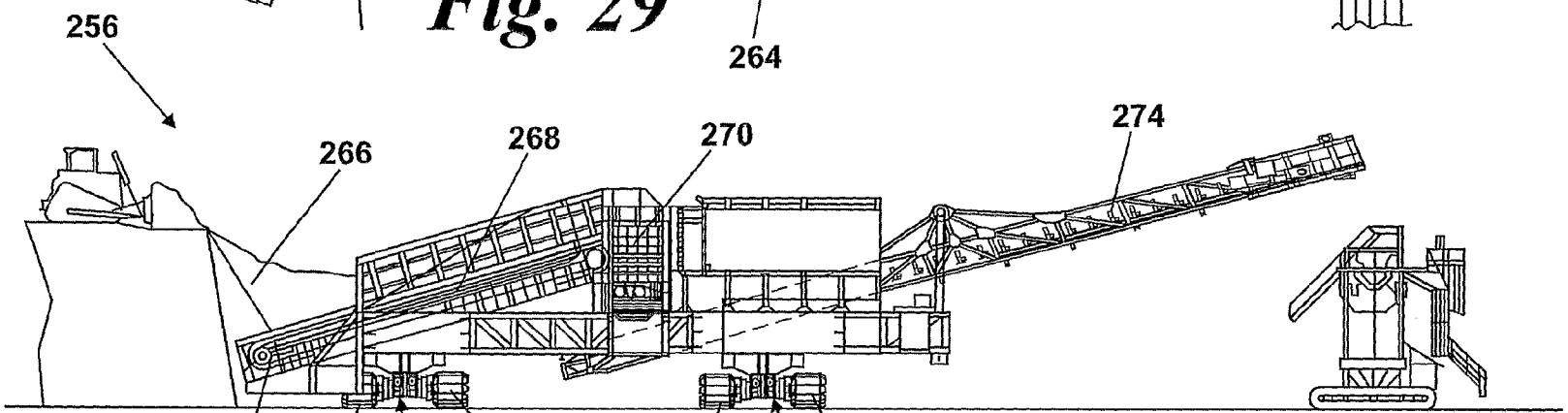
FIG. 28 is an elevational view of the mobile rig shown in FIG. 26 showing the first, second and third transport carriages of the mobile rig in a second orientation relative to the main chassis.

Each of the transport carriages 260, 262, 264 optionally includes a slewing assembly to secure the transport carriage 260, 262, 264 to the main chassis 258 such that the main chassis 258 can slew relative to each transport carriage 260, 262, 264 through a full 360°. This allows, for example, the orientation of the tracks 276, 278 of the transport carriages 260, 262, 264 to be adjusted from a lengthwise direction (FIGS. 26 and 27) to a transverse direction (FIGS. 28 and 29) in the event it is necessary to move the mobile rig 256 in a transverse direction, for example.

Each slewing assembly may include a (typically, toothed) slewing ring secured e.g. on the underside of the main chassis 258 and one or more rotary slewing motors secured e.g. on a respective transport carriage 260, 262, 264 and each having its output shaft drivingly engaged with a respective slewing ring e.g. by way of a pinion. A control arrangement may be provided to permit controlled operation in a slewing mode.

As a result of the rotatable mounting of the main chassis 258 on the second transport carriage 262, the in-ground feeder hopper 266 includes angled wall members located above the intended path of the second transport carriage 262 below the main chassis 258. This arrangement ensures that dug mineral does not impede rotation of the second transport carriage 262 relative to the main chassis 258.

In the embodiment shown in FIGS. 26 and 27 the feeder conveyor 268 is fixed at an angle of approximately 18° relative to level ground, this being an optimized angle of conveyance that prevents material hang-up when considering one particular type of material.

As explained earlier with reference to the other embodiments, other minimum conveyance angles may be suitable for different materials although typically they will be around the value of 18° and in the range of 15-22° to level ground.

A first end 280 of the discharge conveyor 274 is located below a discharge chute 282 of the mineral breaker 270 to receive mineral discharged via the discharge region of the mineral breaker 270.

The discharge conveyor 274 extends at an angle from the first end 280 to a second end 284, and is pivotally connected to the main chassis 258 such that an operator is able to luff the discharge conveyor 274 to accommodate changes in ground terrain while ensuring that the second end 284 of the discharge conveyor 274 remains able to discharge onto a downstream element, such as an overland removal conveyor (not shown). Luffing cylinders may interconnect the discharge conveyor 274 and the main chassis 258 for this purpose.

In use dug mineral is delivered into the in-ground feeder hopper 266 and onto the mineral deposit end 272 of the feeder conveyor 268 for conveyance to the infeed region of the mineral breaker 270.

Following introduction into the mineral breaker 270 via the infeed region of the mineral breaker 270, the mineral is processed to ensure that it contains no lumps over a desired size before being discharged via the discharge chute 282 in the discharge region of the mineral breaker 270 onto the first end 280 of the discharge conveyor 274.

The mineral is then conveyed from the first end 280 of the discharge conveyor 274 to the second end 284 of the discharge conveyor 274 for discharge onto a downstream element (not shown).

Use of the mineral breaker disclosed in European patent application No. 1 725 335 allows oversized material which cannot be broken by the mineral breaker 270 and cannot therefore be discharged via the discharge chute 282 to be removed from the mineral processing route defined by the mobile rig 256. The oversized material is preferably removed by means of a chute (not shown), extending from an opposite side of the miner breaker 270 to the infeed region, to a receptacle.

In another embodiment not shown in the drawings, the discharge conveyor 274 may be constructed to include a first, transfer section fixed generally parallel to level ground below the discharge chute 282 of the mineral breaker 270 to receive and convey mineral from the discharge region of the mineral breaker 270 towards a second, discharge section of the discharge conveyor 274, as described earlier with reference to the mobile rig 110 shown in FIG. 13. In other embodiments of the invention the first section may be fixed at an angle of up to 15° to level ground.

In a yet further embodiment not shown in the drawings, the discharge conveyor 274 may be constructed to include transfer and discharge sections as described earlier with reference to the mobile rigs 124, 176 shown in FIGS. 14, 15 and 17.

Figure 30:
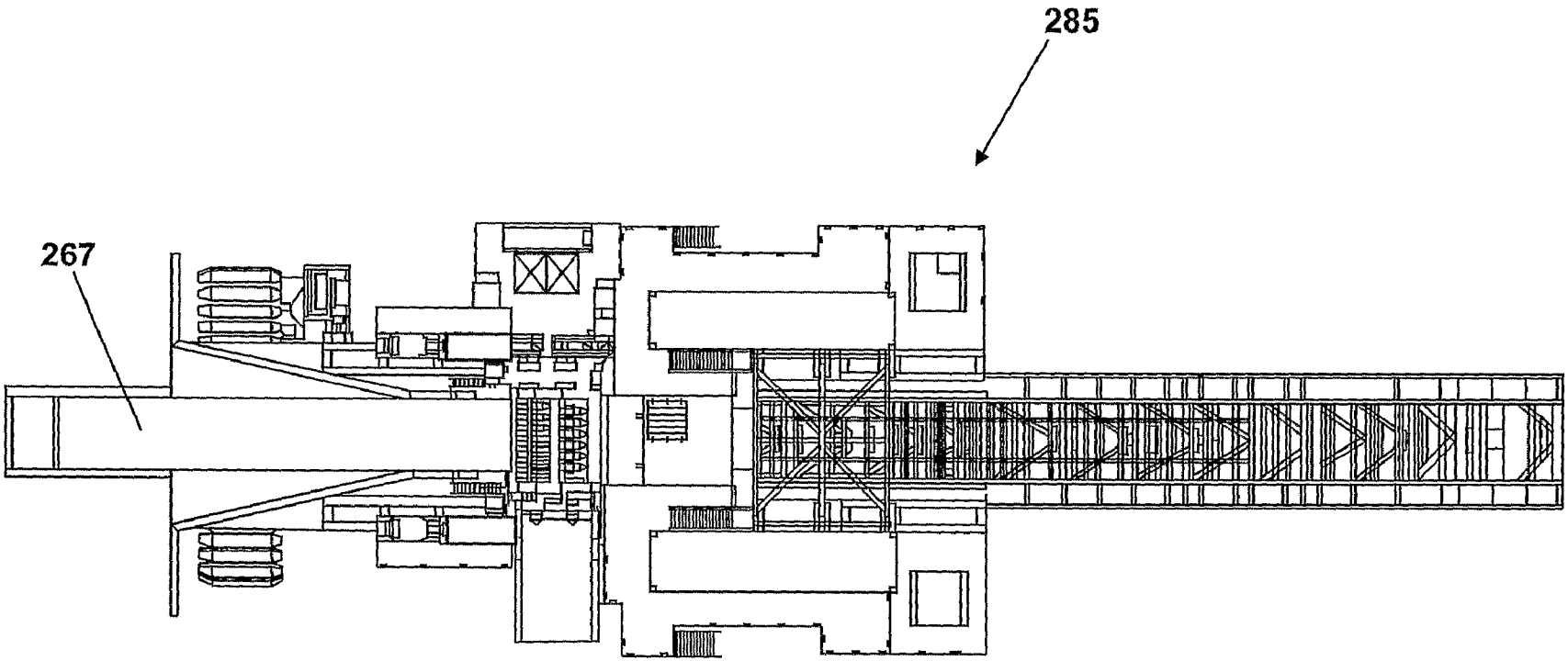
FIG. 30 is a plan view from above of a mobile rig according to an eleventh embodiment of the invention.

It is envisaged that the hopper employed in each of the mobile rigs described with reference to FIGS. 1-4 and 8-19 may be replaced with an in-ground feeder hopper, such as is shown in FIGS. 26 and 27. In this regard a mobile rig 285 according to an eleventh embodiment of the invention is shown in FIG. 30 which is essentially identical to the mobile rig shown in FIG. 16 except that the hopper has been replaced by an in-ground feeder hopper 267.

It is also envisaged that each of the mobile rigs shown and described with reference to FIGS. 1-4, 8-19 and 26-30 may be modified to include a feed device such as the feed device 286 shown in FIGS. 31(*a*), 31(*b*), and 32.

The feed device 286 comprises a container 288 and three transfer members 290. Other embodiments of the invention may include a greater number or a fewer number of transfer members 290.

The container 288 includes a deposit aperture 292 through which dug mineral (not shown) is deposited into the container 288. In the embodiment shown the deposit aperture 292 is defined by an open top of the container 288.

Figure 31A:
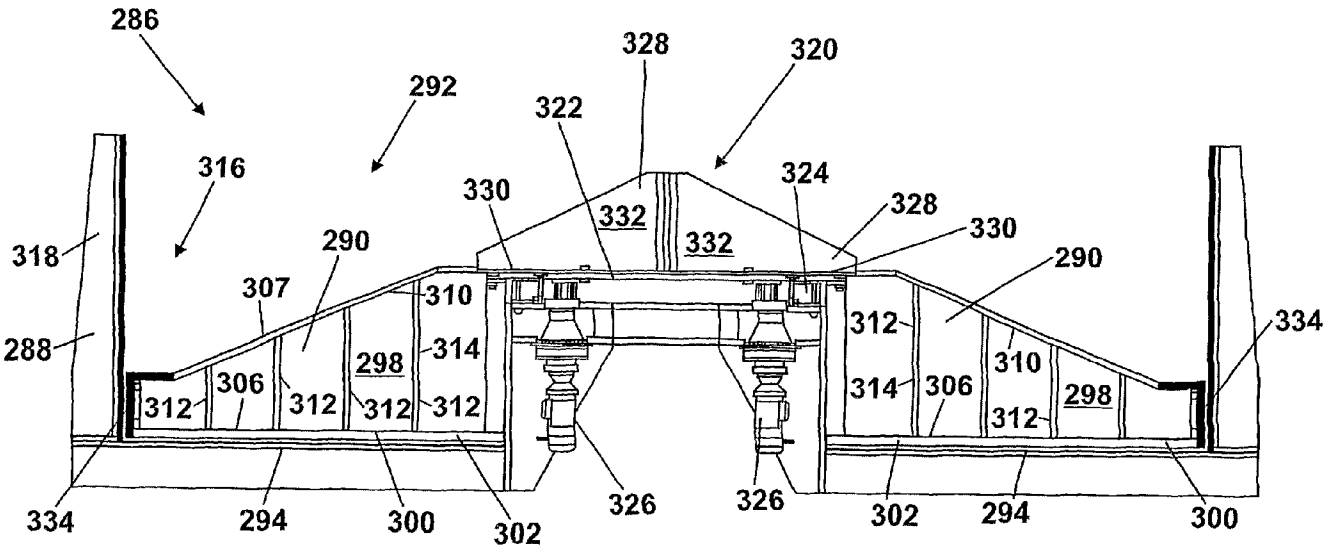
FIG. 31(*a*) is a sectional view of a feed device for incorporation in the mobile rig shown in any of FIGS. 1-30.
Figure 32:
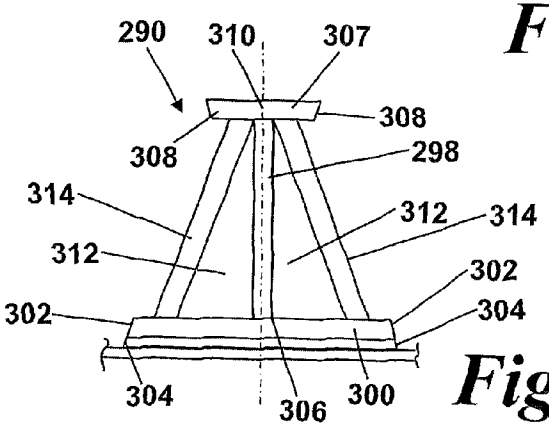
FIG. 32 is a side view along the line A-A of the feed device shown in FIG. 31(*a*)
Figure 31B:
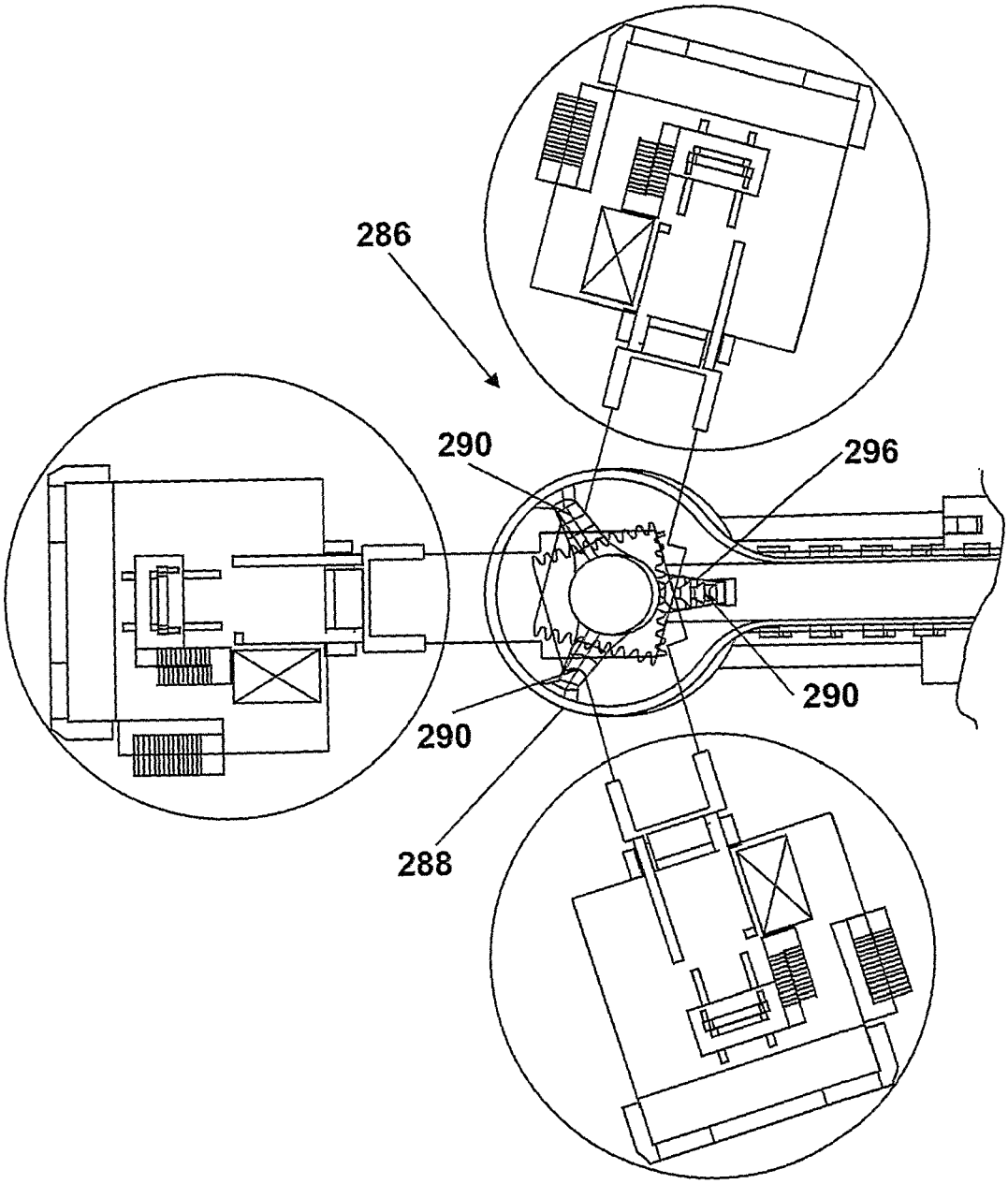

The container 288 also includes a support surface 294 to support the deposited dug mineral, and a discharge aperture 296 located in communication with the support surface 294, and through which dug mineral is discharged to a downstream processing element (not shown in FIG. 31).

The transfer members 290 are moveable relative to the support surface 294 to urge the dug mineral through the discharge aperture 296 towards the downstream processing element.

Each transfer member 290 includes a planar transfer plate 298 and a first support plate 300 which lies adjacent and substantially parallel to the support surface 294 of the container 288. Each side 302 of each first support plate 300 defines a leading edge 304, which is active according to the direction in which the transfer member 290 is moving. Each first support plate 300 is secured to a first edge 306 of the transfer member 290 such that the first support plate 300 and the transfer plate 298 are perpendicular to one another.

Each transfer member 290 also includes a second support plate 307, each side 308 of which defines a leading edge 304. Each second support plate 306 is secured to a second edge 310 of the transfer member 290, opposite the first edge 306, such that the second support plate 306 and the transfer plate 298 are perpendicular to one another.

The transfer members 290 also include four support webs 312 which, in the embodiment shown, are secured between the transfer plate 298 and each of the first and second support plates 300, 307. Other embodiments of the invention may include a different number and arrangement of support webs 312.

Each support web 312 includes an exposed edge 314 which defines a leading edge 304.

In the embodiment shown, each of the leading edges 304 is chamfered so as to define a blade to cut and break up dug mineral.

Other embodiments of feed device 286 may include transfer members 290 having differing combinations and arrangements of transfer plate 298, first support plate 300, second support plate 306 and support web 312 depending on the nature of dug mineral being mined.

The three transfer members 290 rotate within the container 288.

The container 288 shown in the figures defines a bowl 316 which is substantially circular when viewed in plan, and which has a side wall 318 that extends substantially perpendicular to the support surface 294.

The feed device 286 also includes a rotor assembly 320 that includes a rotor housing 322 to which the three transfer members 290 are secured. The three transfer members 290 are equally spaced around the periphery of the rotor housing 322. Other embodiments of the invention may include a differing number and/or differently spaced transfer members 290 secured to the rotor housing 322.

The rotor assembly 320 is located within the bowl 316 and also rotates therein.

The rotor housing 322 includes a toothed ring 324 and the feed device 286 further includes six motors 326 (only two shown), each motor 326 being engaged with the toothed ring 324 to rotate the rotor assembly 320. Other numbers of motor 326 are also possible.

The rotor housing 322 also includes three distribution members 328 secured to an exposed surface 330 thereof. Preferably each distribution member 328 is in the form of a triangular plate 332 which is radially aligned with a corresponding transfer member 290. In use the distribution members 328 direct dug mineral away from the exposed surface 330 of the rotor housing 322 towards the support surface 294 of the container 288.

Each transfer member 290 includes a wear member 334 that is located between the transfer member 290 and the side wall 318 of the container 288 relative to which an end of the transfer member 290 moves during use.

The container 288 may include one or more heaters (not shown) to warm the dug mineral deposited therein.

In use the container 288 of the feed device 286 defines a large target for shovels to load dug mineral into. In addition, the inclusion of a support surface 294 allows the container 288 to act as a reservoir of dug mineral which accommodates interruptions in the loading of dug mineral into the feed device 286 while maintaining a continuous supply of dug mineral to a downstream processing element.

The rotor assembly 320 rotates, typically at ½ a rpm, within the bowl 316 of the container 288 to move the transfer members 290 in an arc over the support surface 294. This movement distributes the dug mineral within the container 288 and urges it through the discharge aperture 296. During such movement the first and second support plates 300, 307 and the support webs 312 act to break up the dug mineral which assists in urging it through the discharge aperture 296.

It is possible to alter the rotational speed of the rotor assembly 320 to, for example, vary the bed depth on a downstream conveyor onto which the dug mineral is discharged through the discharge aperture 296. In this way it is possible to vary the throughput of dug mineral to downstream equipment.

It is also possible to vary the rotational speed of the rotor assembly 320 to accommodate changes to the speed of, for example, the downstream conveyor. In this way it is possible to maintain a given bed depth on the downstream conveyor regardless of changes to the speed of the downstream conveyor.

In addition, since the dug mineral is evenly distributed within the container 288 the power requirement of such a downstream conveyor is reduced because it only has to pull a given bed depth of dug mineral, rather than a large and heavy concentration of dug mineral.

The use of a cylindrical bowl in the feed device 286 shown in FIGS. 31(*a*), 31(*b*), and 32 is advantageous in that it opens up the possibility of using a single transport carriage.

Figure 33:
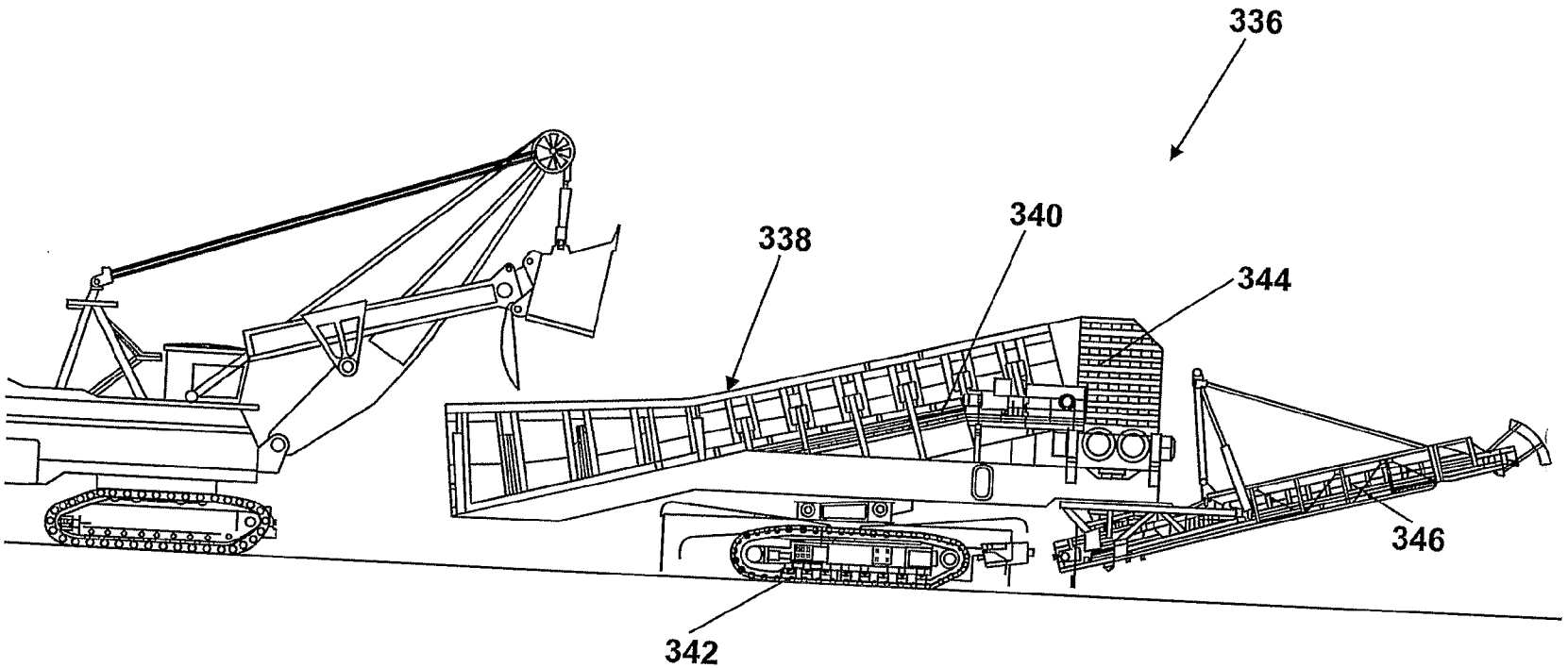
FIG. 33 is an elevational view of a mobile rig according to a twelfth embodiment of the invention incorporating the feed device shown in FIGS. 31 and 32.
Figure 34:
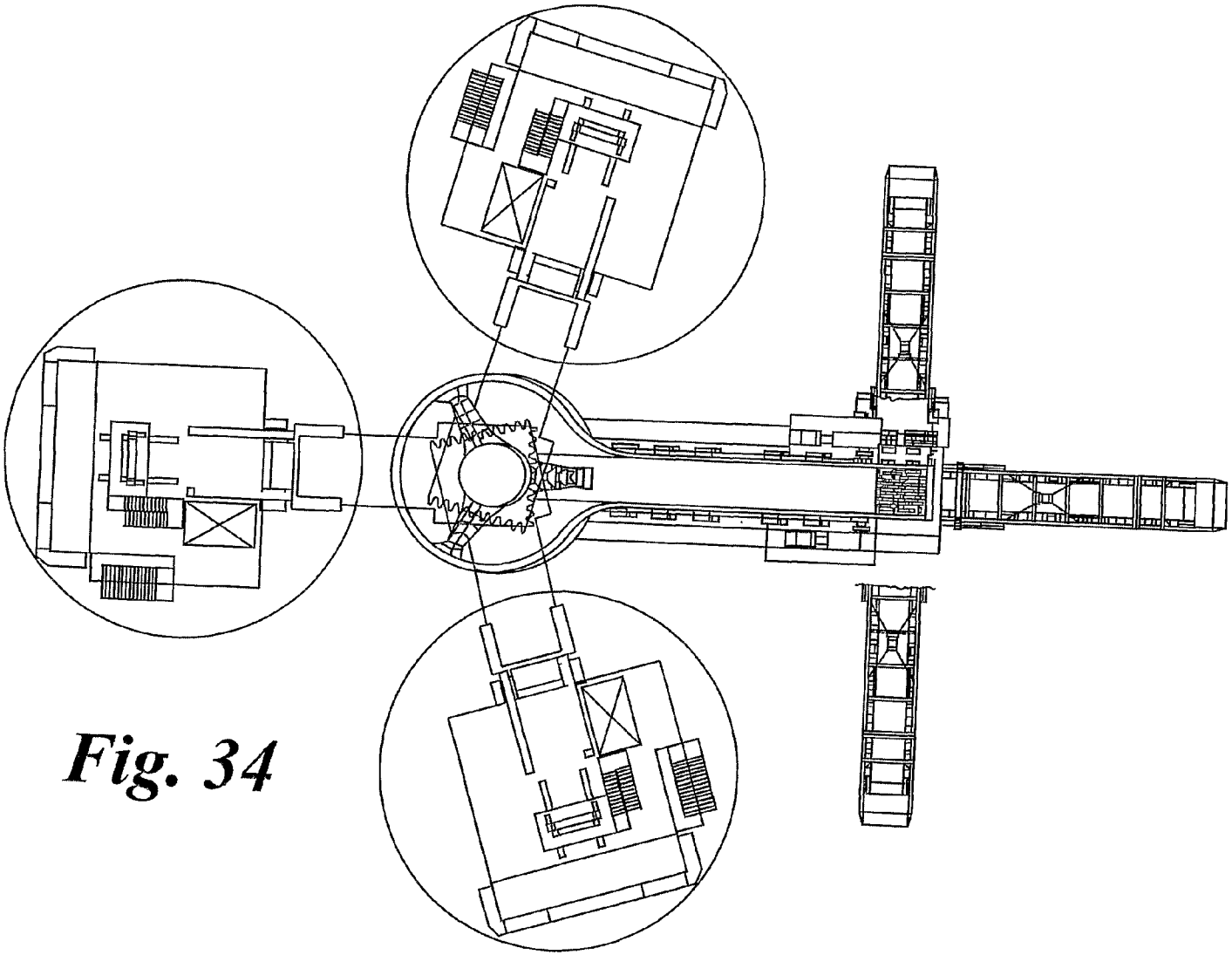
FIG. 34 is a plan view from above of the mobile rig shown in FIG. 33.

Such an arrangement is shown in FIGS. 33 and 34, which show a mobile rig 336 that includes a cylindrical bowl-type feeder 338, of the same or similar type to those described hereinabove with reference to FIGS. 31(*a*), 31(*b*) and 32, whose discharge aperture feeds mineral material onto a feed conveyor 340 that is also the same as or similar to the arrangement previously described. The main difference however between the mobile rig 336 shown in FIGS. 33 and 34 on the one hand and, for example, the mobile rig shown in FIGS. 14 and 15 on the other is that the rig 336 is supported on a single transport carriage 342.

The transport carriage 342 underlies the feed conveyor 340 at a location chosen such that the mass of a mineral breaker 344 located at the end of the feed conveyor 340 that lies remote from the feeder 338 is balanced by the mass of the feeder 338.

The possibility of this arrangement derives principally from the fact that the employment of a cylindrical bowl means that the feeder 338 may be made virtually to any size and hence may be large enough to balance the mass of the breaker 344. Since in many applications the rig 336 will be in continuous use the mass of mineral permanently in the feeder 338 may also contribute to the balancing effect.

The mass of mineral deposited as each shovel load in the feeder 338 typically may be approximately 100 tonnes and it may be necessary to react the impulses of such loads during use of the rig 336. This may be achieved for example through the inclusion of a hydraulic damper (or any of a range of equivalent means) acting to stabilize the rig 336 relative to the ground.

The feed conveyor 340 is shown secured on the upper side of the transport carriage 342 by way of a pivot that is hydraulically operable in order to provide for adjustment of the angle of inclination of the conveyor 340. The pivot however may be omitted and a slewing ring and motor arrangement provided instead, the slewing ring and motor arrangement being operable to permit controlled slewing of the major part of the rig 336 relative to the transport carriage 342. In a further embodiment, both a pivot, and a slewing ring and motor arrangement may be provided, so as to permit angular adjustment of the conveyor 340 and slewing of the major part of the rig 336 relative to the transport carriage 342.

The discharge of the mineral breaker 344 feeds to a transfer conveyor 346 by means of a motorized pivot arrangement. This permits selective rotation of the transfer conveyor 346 as shown schematically in FIG. 34 to feed a processed mineral material to e.g. a number of waiting trucks. The angle of the transfer conveyor 346 relative to the ground is also adjustable through use of the hydraulic ram assembly that is visible in FIG. 33.

The apparatus of FIGS. 33 and 34 is, like the other embodiments of the invention, capable of efficient operation to process minerals even while being moved from place to place about a mine.

As is apparent from FIGS. 33 and 34 hereof the feeder 338 is similarly inclined to the ground, whereby the axis of rotation of the rotor assembly is at right angles to the bed of the feed conveyor 340.

This produces particular advantages in terms of avoiding freezing or hang-up of dug mineral material in the feeder 338 itself. This is because in effect the rearmost portion of the circular wall of the feeder (i.e. the portion of the feeder that is spaced furthest from the discharge aperture), where the effective angle of inclination encountered by mineral material falling from the shovels is at its shallowest, is inclined at 75° to the ground (assuming the feed conveyor angle is) 15° and the parts of wall, adjacent the discharge aperture, will also be inclined such that hang-up is prevented. At all further points of the wall between the aforesaid portions the angle of inclination of wall is adequate to prevent the freezing or hang-up problems mentioned, being at least as steep as the "rearmost" part.

Nevertheless, in other embodiments of the invention the cylindrical bowl of the feeder 338 may be inclined at an angle to the bed of the feed conveyor 340, and so the axis of rotation of the corresponding rotor assembly may extend at an angle other than 90° to the bed of the feed conveyor 340

In addition to the foregoing the use of an essentially cylindrical bowl for the feeder 338 eliminates the valleys that arise at the joints between the flat plates of pyramidal hoppers of the prior art. The angles of such valleys relative to the ground in prior art hoppers can be small enough to give rise to the hang-up problem.

A further advantage of using a circular bowl lies in the ability to employ the rotor assembly to drive material onto the feed conveyor 340. This provides for continuous clearing out of the container such that the shovels may continuously replenish it without the height to which dug mineral material is piled becoming inconvenient.

Use of a cylindrical bowl additionally confers great versatility on a rig 336 made in accordance with the invention. This is not least because the designer may vary at will the diameter, and hence the volume, of the bowl in order e.g. to accommodate differing shovel sizes, without any requirement in design terms for the feeder size to be related to the size of the feed conveyor.

Thus in a further broad aspect, that is applicable to all embodiments, the invention may be considered to reside in a container or hopper, for a mobile mineral processing rig, the container including one or more side walls the inclination of which, relative to the ground, in use exceeds a predetermined minimum value that is sufficient to prevent or substantially eliminate mineral hang-up in the container.

More specifically the invention resides in an essentially cylindrical container, for a mobile mineral rig, the container defining a centre axis that is in use inclined relative to the ground at such an angle that all parts of a side wall forming part of the container are inclined at least at an angle that prevents or eliminates hang-up of the mineral being processed.

In an advantageous embodiment of the invention, as stated, the cylindrical container may contain a rotor assembly whose axis of rotation coincides with the aforesaid centre axis. As noted, such an arrangement gives rise to various advantages that are not available in the prior art.

Figure 35:
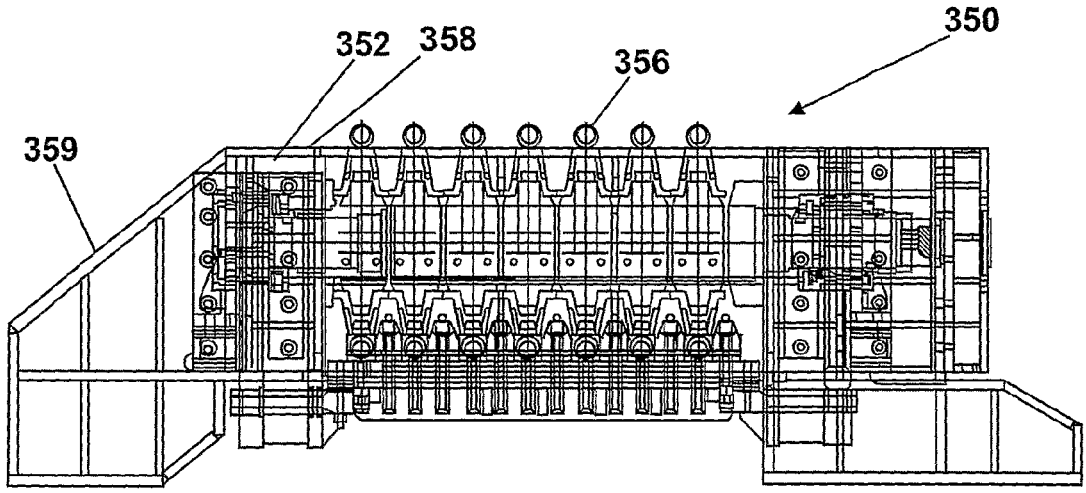
FIG. 35 is a side view of a mineral breaker for incorporation in the mobile rig shown in any of FIGS. 1-30 and 34.
Figure 36:
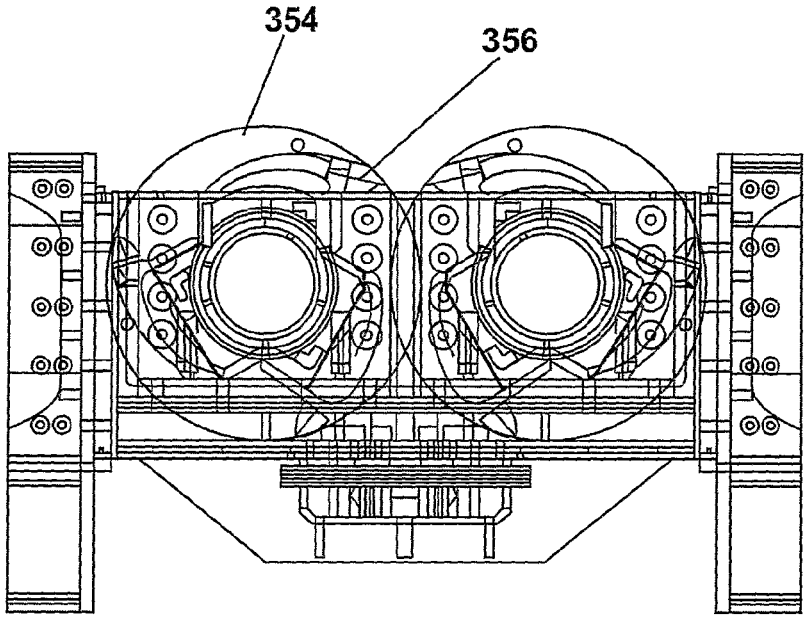
FIG. 36 is an elevational view of the mineral breaker show in FIG. 35.

In other embodiments of the invention, the mineral breaker provided in each of the mobile rigs shown in FIGS. 1-4, 8-19 and 26-30 may be replaced by the mineral breaker 350 shown in FIGS. 35 and 36.

The breaker 350 includes at its uppermost (mineral infeed) end a frame 352 in which are rotatably journalled the shafts of respective, mutually meshed breaker drums. The latter are of per se known design and each includes a series of breaker rings 354 supporting a further series of breaker teeth 356. The frame 352 defines as its uppermost surface a shelf 358 that in use is horizontal. The shelf 358 declines steeply downwards as shown at 359 a short distance from the breaker drums, the horizontal length of shelf being effectively the minimum needed to accommodate a journal bearing or gearbox (or other component, depending on the design of breaker) accommodated within frame 352 beneath it.

The heights of the walls of frame 352 are such that the tips of the teeth 356 are exposed for at least part of the rotation of the breaker drums.

In such embodiments, the main chassis preferably supports a maintenance booth adjacent the breaker and at generally the same level as it. This permits convenient maintenance operations.

Figure 37:
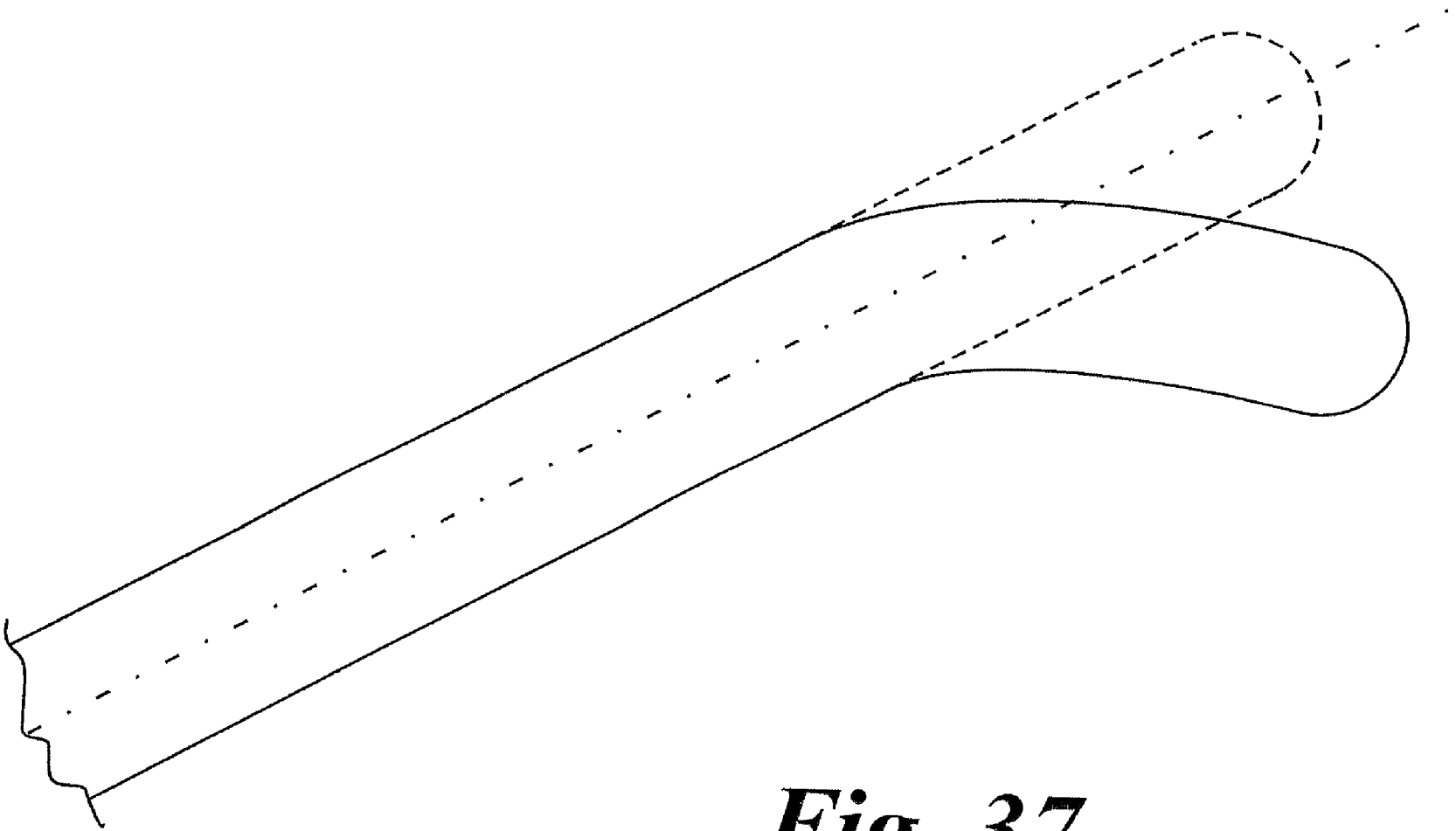
FIG. 37 is a schematic partial view of a discharge conveyor for incorporation in the mobile rig shown in any of FIGS. 1-30 and 34.

The discharge conveyor in any of the embodiments shown in FIGS. 1-4, 8-19 and 26-30 may be fanned so as to include an end portion adjacent to the second end thereof which is moveable between a first, erect configuration in which the end portion lies in line with the remainder of the discharge conveyor, as shown by dashed lines in FIG. 37, and a second, drooped configuration in which the end portion adopts a lower, curved profile, as shown in FIG. 37.

The invention claimed is:

1. A mobile rig, for processing mineral material, comprising a feeder including a feed device for receiving mineral and a feeder conveyor arranged to convey mineral; a main chassis supporting a mineral breaker; and a discharge conveyor, the mineral breaker having an infeed region via which it receives mineral and a discharge region via which it discharges mineral after processing in the mineral breaker, the feeder conveyor being such as to convey mineral from the feed device to the infeed region of the mineral breaker and the discharge conveyor being such as to convey mineral from the discharge region of the mineral breaker, wherein the feeder conveyor is fixedly mounted relative to the mineral breaker such that its position relative to the mineral breaker remains the same irrespective of the orientation of the main chassis relative to the ground, and wherein the rig includes a primary transport carriage on which the main chassis is supported above ground in use.

2. A mobile rig according to claim 1 wherein the main chassis is supported on the primary transport carriage so as to be pivotable relative to the primary transport carriage to raise and lower the feeder relative to the ground.

3. A mobile rig according to claim 2 wherein the feeder includes a rigid frame structure projecting downwardly from the main chassis such that a lower end of the feeder is lowered to seat on the ground or raised to clear the ground solely by pivoting of the main chassis relative to the primary transport carriage.

4. A mobile rig according to claim 1 further including an auxiliary transport carriage arranged to support the feeder conveyor and/or the feed device.

5. A mobile rig according to claim 4 wherein the feeder conveyor and/or the feed device are pivotably supported on the auxiliary transport carriage to negotiate ground undulations without significantly altering the orientation of the feeder conveyor and/or the feed device.

6. A mobile rig according to claim 1 wherein the primary transport carriage includes a pair of parallel, driven, ground-engaging tracks and the rig includes one or more control devices for selectively driving the respective said tracks at different speeds so as to effect steering of the primary transport carriage.

7. A mobile rig according to claim 6 wherein the orientation of the ground-engaging tracks relative to the main chassis is fixed in a transverse direction.

8. A mobile rig according to claim 1 wherein the main chassis is rotatably supported on the primary transport carriage to permit rotation of the main chassis relative to the primary transport carriage, wherein the axis of rotation relative to the transport carriage is in use generally vertical.

9. A mobile rig according to claim 8 including a slewing gear interconnecting the main chassis and the primary transport carriage to effect selective, powered rotation of the main chassis relative to the primary transport carriage.

10. A mobile rig according to claim 9 wherein the slewing gear includes a slewing ring secured to one of the main chassis and the primary transport carriage; at least one slewing motor that is secured to the other of the main chassis and the primary transport carriage and having an output shaft that is drivingly engaged with the slewing ring.

11. A mobile rig according to claim 1, wherein the rig includes first and second transport carriages on which the main chassis is supported, the first and second transport carriages being arranged in a spaced, parallel configuration and orientated relative to the main chassis in a fixed transverse direction.

12. A mobile rig according to claim 11 wherein each of the first and second transport carriages includes a single, driven, ground-engaging track.

13. A mobile rig according to claim 11 wherein the main chassis is pivotably supported on the first transport carriage to negotiate ground undulations without significantly altering the orientation of the main chassis.

14. A mobile rig according to claim 13 wherein the first transport carriage is pivotally mounted between a pair of opposed frame elements, each frame element including a pivot shaft bearing to receive a pivot shaft extending from a respective side of the ground-engaging track so as to define a co-axial pivot joint on each side of the ground-engaging track, and wherein a buffer assembly is provided on each side of each pivot joint to resist movement of the ground-engaging track towards either frame element on either side of each pivot joint.

15. A mobile rig according to claim 14 wherein each buffer assembly includes a buffer element extending from a respective side of the ground-engaging track and a corresponding buffer element extending from a respective frame element such that buffer faces on the buffer elements about each other.

16. A mobile rig according to claim 15 wherein the buffer faces on the buffer elements of each buffer assembly are shaped to maintain abutting contact between the buffer faces through a range of pivotal movement of the ground-engaging track relative to the frame elements.

17. A mobile rig according to claim 11 wherein the rig includes one or more control devices for selectively driving the respective said transport carriages at different speeds so as to effect steering of the rig.

18. A mobile rig according claim 1 wherein a mineral receiving end of the discharge conveyor is located below a discharge chute of the mineral breaker to receive and convey mineral from the discharge region of the mineral breaker towards a mineral discharge end, the discharge conveyor being pivotable to permit adjustment of the angle of inclination of the discharge conveyor to level ground.

19. A mobile rig according to claim 1 wherein the discharge conveyor includes a transfer section fixed generally parallel to level ground below a discharge chute of the mineral breaker to receive and convey mineral from the discharge region of the mineral breaker towards a discharge section of the discharge conveyor which is pivotable relative to the transfer section of the discharge conveyor to permit adjustment of the angle of inclination of the discharge section of the discharge conveyor to level ground.

20. A mobile rig according to claim 1 wherein the discharge conveyor includes a transfer section extending from the discharge region of the mineral breaker to convey mineral from the discharge region of the mineral breaker to a transfer region where it transfers mineral to a discharge section of the discharge conveyor, the transfer section of the discharge conveyor being fixed at a predetermined angle relative to level ground and the discharge section of the discharge conveyor being pivotable relative to the transfer section of the discharge conveyor to permit adjustment of the angle of inclination of the discharge section of the discharge conveyor to level ground.

21. A mobile rig according to claim 20 wherein the discharge section of the discharge conveyor is hingedly mounted on the main chassis to permit rotation of the discharge section relative to the main chassis and a driving means is provided to effect selective, powered rotation of the discharge section of the discharge conveyor relative to the main chassis.

22. A mobile rig according to claim 1 wherein the feed device of the feeder includes an in-ground feeder hopper formed by walls of compacted mineral erected to surround the sides and end of a mineral deposit end of a feeder conveyor.

23. A mobile rig according to claim 1 wherein the mineral breaker includes a gearbox or a journal bearing and a frame defining an upwardly facing reject shelf overlying the gearbox or journal bearing and onto which, during use of the mineral breaker, rejected mineral passes, the reject shelf declining downwardly from a location corresponding generally to the lateral extent of the gearbox or journal bearing relative to the frame.

24. A mobile rig according to claim 1 wherein the feeder conveyor extends between the feed device and the main chassis at an angle in the range of 15-22° to level ground.

25. A mobile rig according to claim 1, wherein the feed device, feeder conveyor, main chassis, mineral breaker and discharge conveyor are arranged such that their combined centre of gravity lies over the primary transport carriage throughout the range of pivotal displacement of the main chassis relative to the primary transport carriage.

* * * * *

US008020800C1

(12) INTER PARTES REEXAMINATION CERTIFICATE (534th)

United States Patent

Potts

(10) Number: US 8,020,800 C1

(45) Certificate Issued: Feb. 15, 2013

(54) MOBILE RIGS

(75) Inventor: Alan Potts, Fontvielle (MC)

(73) Assignee: MMD Design & Consultancy Ltd., Somercotes, Derbyshire (GB)

Reexamination Request:
No. 95/002,284, Sep. 14, 2012

Reexamination Certificate for:

| | |
|---|---|
| Patent No.: | **8,020,800** |
| Issued: | **Sep. 20, 2011** |
| Appl. No.: | **12/440,901** |
| Filed: | **Mar. 11, 2009** |

(21) Appl. No.: 95/002,284

(22) PCT Filed: Sep. 12, 2007

(86) PCT No.: PCT/GB2007/003449

§ 371 (c)(1), (2), (4) Date: Mar. 11, 2009

(87) PCT Pub. No.: WO2008/032057

PCT Pub. Date: Mar. 20, 2008

(30) Foreign Application Priority Data

| | | |
|---|---|---|
| Sep. 12, 2006 | (GB) | 0617904.8 |
| Feb. 13, 2007 | (GB) | 0702819.4 |
| Feb. 14, 2007 | (GB) | 0702845.9 |
| Feb. 14, 2007 | (GB) | 0702848.3 |
| Feb. 20, 2007 | (GB) | 0703247.7 |
| Mar. 12, 2007 | (GB) | 0704730.1 |
| Apr. 24, 2007 | (GB) | 0707901.5 |

(51) Int. Cl.
*B02C 21/02* (2006.01)

(52) U.S. Cl. ..... 241/101.74

(58) Field of Classification Search ..... None
See application file for complete search history.

(56) References Cited

To view the complete listing of prior art documents cited during the proceeding for Reexamination Control Number 95/002,284, please refer to the USPTO's public Patent Application Information Retrieval (PAIR) system under the Display References tab.

*Primary Examiner* — Peter C. English

(57) ABSTRACT

A mobile rig for processing mineral material, comprising a feeder including a feed device for receiving mineral and a feeder conveyor arranged to convey mineral. The mobile rig includes a main chassis supporting a mineral breaker; and a discharge conveyor. The mineral breaker has an infeed region via which it receives mineral and a discharge region via which it discharges mineral after processing in the mineral breaker. The feeder conveyor is such as to convey mineral from the feed device to the infeed region of the mineral breaker and the discharge conveyor is such as to convey mineral from the discharge region of the mineral breaker. The rig includes a primary transport carriage on which the main chassis is supported.

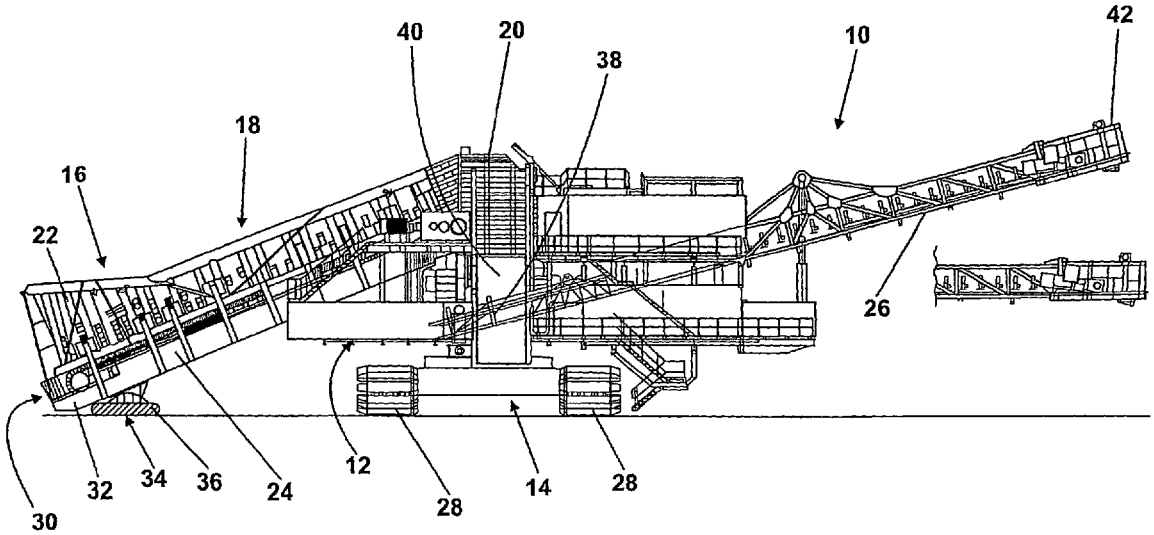

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-13 and 17-25 are cancelled.

Claims 14-16 were not reexamined.

* * * * *